US011718949B2

(12) United States Patent
Kim et al.

(10) Patent No.: US 11,718,949 B2
(45) Date of Patent: Aug. 8, 2023

(54) DRYER AND METHOD FOR CONTROLLING THE SAME

(71) Applicant: SAMSUNG ELECTRONICS CO., LTD., Suwon-si (KR)

(72) Inventors: Dohaeng Kim, Suwon-si (KR); Kookjeong Seo, Suwon-si (KR); Dongsuk Kim, Suwon-si (KR); Juyoung Kim, Suwon-si (KR); Jewoo Bang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 406 days.

(21) Appl. No.: 16/951,389

(22) Filed: Nov. 18, 2020

(65) Prior Publication Data

US 2021/0156073 A1 May 27, 2021

(30) Foreign Application Priority Data

Nov. 21, 2019 (KR) ..... 10-2019-0150133

(51) Int. Cl.
*D06F 58/38* (2020.01)
*D06F 58/20* (2006.01)
(Continued)

(52) U.S. Cl.
CPC ..... *D06F 58/38* (2020.02); *D06F 34/18* (2020.02); *D06F 58/04* (2013.01); *D06F 58/206* (2013.01);
(Continued)

(58) Field of Classification Search
CPC ..... D06F 58/38; D06F 34/18; D06F 58/04; D06F 58/206; D06F 2103/04;
(Continued)

(56) References Cited

U.S. PATENT DOCUMENTS 8,868,243 B2 * 10/2014 Kim ..... D06F 58/48 700/275
10,100,460 B2 * 10/2018 Bisaro ..... D06F 58/34
(Continued)

FOREIGN PATENT DOCUMENTS

JP 2759045 5/1998
KR 10-2006-0133847 12/2006
(Continued)

OTHER PUBLICATIONS

International Search Report dated Mar. 15, 2021 in International Patent Application No. PCT/KR2020/016433.

*Primary Examiner* — Stephen M Gravini
(74) *Attorney, Agent, or Firm* — Staas & Halsey LLP

(57) ABSTRACT

A dryer according to the disclosure may detect current flowing through a motor for rotating a drum, detect humidity of a drying material accommodated in the drum, compare the detected humidity to a plurality of pieces of reference humidity and compare the detected current to a plurality of pieces of reference current to obtain a drying load, control a revolutions per minute (rpm) of the motor, a frequency of a compressor provided in a heat pump, and a degree of superheat of an evaporator provided in the heat pump based on the drying load, perform a drying process, detect humidity of the drying material while the drying process is performed, and finish the drying process in response to the detected humidity determined to be target humidity.

20 Claims, 13 Drawing Sheets

(51) Int. Cl.

| | |
|---|---|
| ***D06F 58/04*** | (2006.01) |
| ***D06F 34/18*** | (2020.01) |
| ***D06F 105/30*** | (2020.01) |
| ***D06F 103/46*** | (2020.01) |
| ***D06F 105/46*** | (2020.01) |
| ***D06F 105/26*** | (2020.01) |
| ***D06F 103/04*** | (2020.01) |
| ***D06F 103/08*** | (2020.01) |

(52) U.S. Cl.
CPC ..... *D06F 2103/04* (2020.02); *D06F 2103/08* (2020.02); *D06F 2103/46* (2020.02); *D06F 2105/26* (2020.02); *D06F 2105/30* (2020.02); *D06F 2105/46* (2020.02)

(58) Field of Classification Search
CPC ..... D06F 2103/08; D06F 2103/46; D06F 2105/30; D06F 2105/26; D06F 2105/46
USPC ..... 34/427, 595–610
See application file for complete search history.

(56) References Cited

U.S. PATENT DOCUMENTS

| | | | | |
|---|---|---|---|---|
| 10,876,249 | B2 * | 12/2020 | Kamii | D06F 58/38 |
| 10,914,033 | B2 * | 2/2021 | Kim | D06F 58/26 |
| 11,242,634 | B2 * | 2/2022 | Ahn | D06F 33/44 |
| 2021/0039109 | A1 * | 2/2021 | Hoen | B02C 18/067 |
| 2021/0156073 | A1 * | 5/2021 | Kim | D06F 58/04 |
| 2022/0341083 | A1 * | 10/2022 | Park | G06N 3/084 |

FOREIGN PATENT DOCUMENTS

| | | | | |
|---|---|---|---|---|
| KR | 10-2011-0080620 | | 7/2011 | |
| KR | 10-2019-0057659 | | 5/2019 | |
| KR | 10-2019-0065150 | | 6/2019 | |
| KR | 10-2019-0065151 | | 6/2019 | |
| KR | 20210062210 | A * | 5/2021 | |
| WO | WO-2021101301 | A1 * | 5/2021 | D06F 34/18 |

* cited by examiner

FIG. 9

| DRYNESS | ITEMS TO DETERMINE FINISHING | VALUE |
|---|---|---|
| WEAK | ABSOLUTE HUMIDITY AT OUTLET,g/m$^3$ | UNDER 40 |
| | P(CHANGE PATTERN OF G VALUE) | UNDER 0 |
| | G ≤ Gend | MAINTAIN FOR ONE MINUTE |
| MEDIUM | ABSOLUTE HUMIDITY AT OUTLET,g/m$^3$ | UNDER 35 |
| | P(CHANGE PATTERN OF G VALUE) | UNDER 0 |
| | G ≤ Gend | MAINTAIN FOR ONE MINUTE |
| STRONG | ABSOLUTE HUMIDITY AT OUTLET,g/m$^3$ | UNDER 30 |
| | P(CHANGE PATTERN OF G VALUE) | UNDER 0 |
| | G ≤ Gend | MAINTAIN FOR ONE MINUTE |

| Gend | | |
|---|---|---|
| DRYNESS | WEAK | −0.08 |
| | MEDIUM | −1.0 |
| | STRONG | −1.2 |

FIG. 10

| DRYNESS | ITEMS TO DETERMINE FINISHING | VALUE |
|---|---|---|
| WEAK | ABSOLUTE HUMIDITY AT OUTLET,g/m$^3$ | UNDER 40 |
| | P(CHANGE PATTERN OF G VALUE) | UNDER 0 |
| | $\Delta G \leq$ Gend | MAINTAIN FOR ONE MINUTE |
| MEDIUM | ABSOLUTE HUMIDITY AT OUTLET,g/m$^3$ | UNDER 35 |
| | P(CHANGE PATTERN OF G VALUE) | UNDER 0 |
| | $\Delta G \leq$ Gend | MAINTAIN FOR ONE MINUTE |
| STRONG | ABSOLUTE HUMIDITY AT OUTLET,g/m$^3$ | UNDER 30 |
| | P(CHANGE PATTERN OF G VALUE) | UNDER 0 |
| | $\Delta G \leq$ Gend | MAINTAIN FOR ONE MINUTE |

| Gend | | |
|---|---|---|
| DRYNESS | WEAK | 5 |
| | MEDIUM | 2 |
| | STRONG | 0.5 |

DRYER AND METHOD FOR CONTROLLING THE SAME

CROSS-REFERENCE TO RELATED APPLICATION

This application is based on and claims priority under 35 U.S.C. § 119 to Korean Patent Application No. 10-2019-0150133, filed on Nov. 21, 2019 in the Korean Intellectual Property Office, the disclosure of which is incorporated by reference herein in its entirety.

BACKGROUND

1. Field

The disclosure relates to a dryer with improved drying capability and energy saving, and a method for controlling the dryer.

2. Description of the Related Art

A dryer is an apparatus for rotating a drum accommodating clothes (hereinafter, referred to as drying materials) to be dried and supplying hot air to the inside of the drum to dry the drying materials.

An existing dryer detects, upon drying of drying materials, a dryness of the drying materials by using an electrode sensor provided in the drum and finishes a drying process based on the dryness. However, due to irregular contacts of the drying materials to the electrode sensor, the existing dryer detects the dryness of the drying materials with low accuracy, resulting in low drying capability.

Upon drying of various kinds of drying materials having different drying speeds, the existing dryer determines the drying progress of the entire drying materials accommodated inside the drum by using a dryness detected by the electrode sensor, without identifying the kinds of the drying materials which contact the electrode sensor and from which the dryness is detected. For this reason, in some cases, the existing dryer has made a wrong determination on the drying progress of the entire drying materials. In these cases, some of the drying materials accommodated inside the drum have been over-dried or half-dried.

Upon drying of a small amount of drying materials, the existing dryer finishes a drying process based on the temperature of the flow passage while hot air heats inside air of the flow passage rather than the drying materials to more raise the inside temperature of the flow passage than the temperature of the drying materials, which causes poor drying of the drying materials.

Upon drying of a large amount of drying materials, the existing dryer finishes a drying process based on the temperature of the flow passage corresponding to dry states of the outer surfaces of the drying materials even though the insides of the drying materials are not sufficiently dried because movements of the drying materials accommodated inside the drum are not easy, so that the drying quality of the drying materials is not guaranteed.

SUMMARY

In accordance with an aspect of the disclosure, a dryer includes: a drum accommodating a drying material; a motor configured to apply a rotating force to the drum; a first detector configured to detect humidity of the drying material and output humidity information corresponding to the detected humidity; a second detector configured to detect current of the motor and output current information corresponding to the detected current; a heat source configured to supply hot air to the drum; and a controller configured to compare the humidity information received from the first detector to reference humidity information, compare the current information received from the second detector to reference current information to determine a drying load, and control a revolutions per minute (rpm) of the motor or the heat source based on the drying load.

The heat source may include a compressor, a condenser connected to the compressor, an expansion valve connected to the condenser, an evaporator connected to the expansion valve, and a heat pump configured to circulate a refrigerant in order of the compressor, the condenser, the expansion valve, and the evaporator, wherein the heat pump may be further configured to supply air heat-exchanged in the condenser to the drum, and control moisture included in air discharged from the drum through heat exchange in the evaporator.

The controller may be further configured to control a frequency of the compressor based on the determined drying load.

The controller may be further configured to control an opening degree of the expansion valve to adjust a degree of superheat of the evaporator based on the determined drying load.

The controller may be further configured to check an opening degree of the expansion valve while a drying process is performed based on the determined drying load, and perform a control operation of finishing the drying process in response to the opening degree checked to be a target opening degree.

The controller may be further configured to control, in response to the drying load determined to be a small load, the motor to operate at a rpm that is smaller than a set rpm, and control, in response to the drying load determined to be a large load, the motor to operate at a rpm that is greater than the set rpm.

The controller may be further configured to perform a control operation of finishing the drying process based on humidity detected by the first detector while the drying process is performed.

The dryer may further include an electrode sensor provided in the drum and configured to output an electrical signal in response to a contact to the drying material, wherein the controller may be further configured to obtain, in response to the drying load determined to be a medium load or a large load, a dryness of the drying material based on the electrical signal of the electrode sensor, and obtain additional time information for additional drying based on time information corresponding to the dryness of the drying material obtained as a reference dryness.

The controller may be further configured to perform a control operation of finishing the drying process based on humidity detected by the first detector while an additional drying process is performed based on the additional time information.

The controller may be further configured to check an opening degree of the expansion valve while an additional drying process is performed based on the additional time information, and perform a control operation of finishing the drying process in response to the opening degree determined to be a target opening degree.

The dryer may further include a fan connected to the motor and configured to circulate air to inside and outside of the drum, wherein the fan may be configured to adjust a volume of air circulating to the inside and outside of the drum to correspond to a rpm of the motor.

The controller may be further configured to determine a drying load to be a small load in response to the detected humidity that is higher than or equal to first reference humidity and lower than second reference humidity and the detected current that is higher than or equal to first reference current and lower than second reference current.

The controller may be further configured to determine no load and perform a control operation of finishing the drying process in response to the detected humidity that is lower than first reference humidity and the detected current that is lower than first reference current.

The controller may be further configured to determine the drying load to be a medium load in response to the detected humidity that is higher than or equal to second reference humidity and lower than third reference humidity and the detected current that is higher than or equal to second reference current and lower than third reference current, and determine the drying load to be a large load in response to the detected humidity that is higher than or equal to the third reference humidity and the detected current that is higher than or equal to the third reference current.

The first detector may include a humidity sensor positioned on an exhaust flow passage through which air discharged from the drum moves.

The dryer may further include a fan configured to circulate air to inside and outside of the drum and a fan motor configured to apply a rotating force to the fan, wherein the controller may be further configured to control a rpm of the fan motor based on the determined drying load.

In accordance to another aspect of the disclosure, a method for controlling a dryer including a heat pump includes: detecting current flowing through a motor for rotating a drum; detecting humidity of a drying material accommodated in the drum; comparing the detected humidity to a plurality of pieces of reference humidity, and comparing the detected current to a plurality of pieces of reference current to determine a drying load; controlling a rpm of the motor or an operation of the heat pump based on the determined drying load; performing a drying process; detecting humidity of the drying material accommodated in the drum while the drying process is performed; and finishing the drying process in response to the detected humidity determined to be target humidity.

The controlling of the operation of the heat pump may include: further decreasing a revolutions per minute (rpm) of the motor, further decreasing a frequency of a compressor provided in the heat pump, and further increasing a degree of superheat of an evaporator provided in the heat pump, as an amount of the determined drying load is smaller than a preset amount; and further increasing the rpm of the motor, further increasing the frequency of the compressor, and further decreasing the degree of superheat of the evaporator, as an amount of the determined drying load is greater than the preset amount.

The performing of the drying process may include: obtaining a dryness of the drying material based on an electrical signal of an electrode sensor provided in the drum; obtaining additional time information for additional drying based on time information corresponding to the dryness of the drying material obtained as a reference dryness; and performing additional drying based on the additional time information.

The performing of the drying process may include obtaining a degree of superheat of an evaporator provided in the heat pump, and reducing an opening degree of an expansion valve provided in the heat pump based on the degree of superheat, and the finishing of the drying process may include checking the opening degree of the expansion valve, and performing a control operation of finishing the drying process in response to the opening degree determined to be a target opening degree.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 9 shows an example of conditions for determining whether to finish drying in a dryer according to an embodiment of the disclosure;

FIG. 10 shows another example of conditions for determining whether to finish drying in a dryer according to an embodiment of the disclosure.

DETAILED DESCRIPTION

Figure 1:
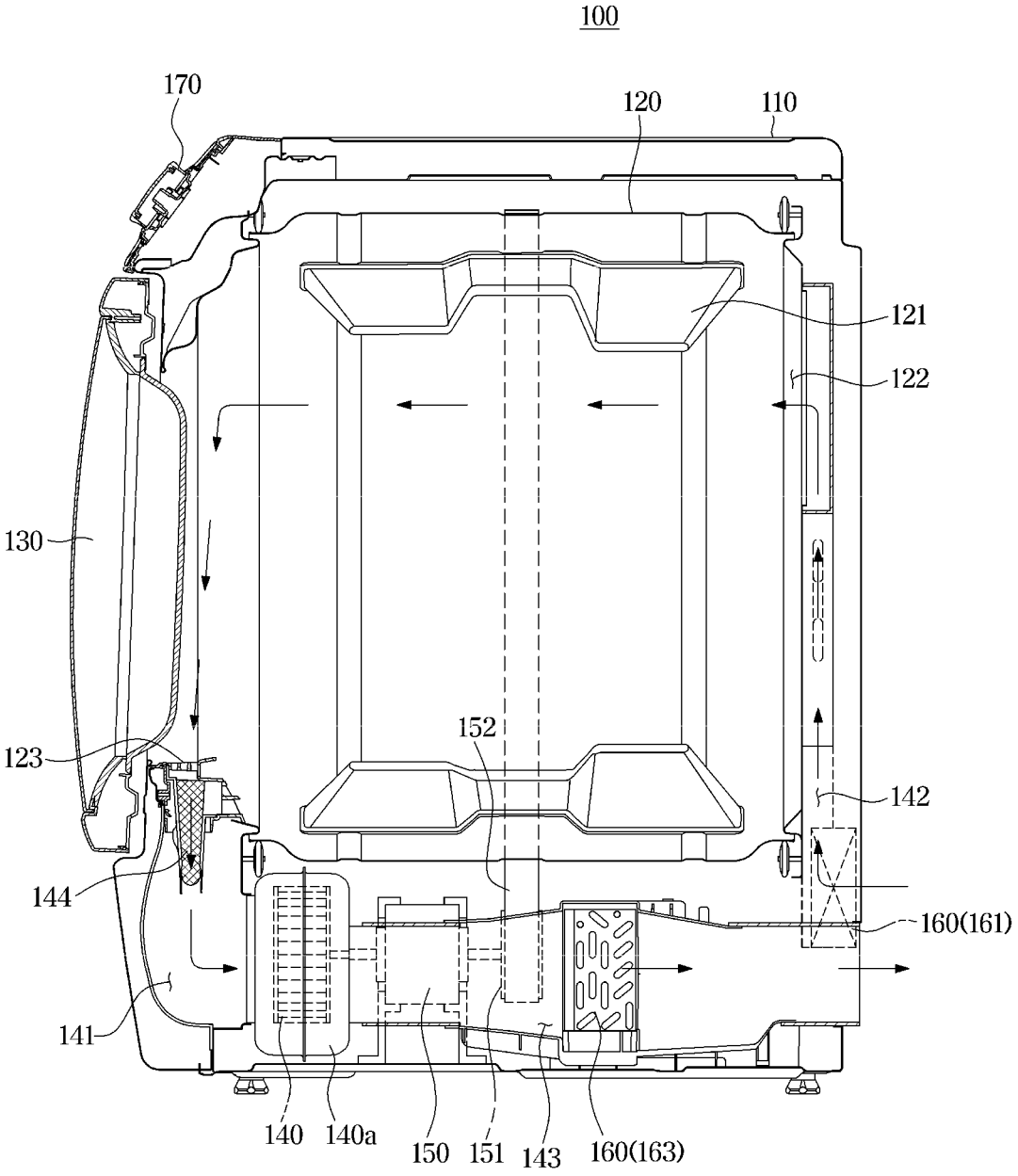
FIG. 1 is a cross-sectional view of a dryer according to an embodiment of the disclosure.

Throughout this specification, like reference numerals will refer to like components. This specification does not describe all components of the embodiments, and general information in the technical field to which the disclosure belongs or overlapping information between the embodiments will not be described.

As used herein, the terms "portion", "part", "module", "member" or "block" may be implemented as software or hardware, and according to embodiments, a plurality of "portions", "parts", "modules", "members" or "blocks" may be implemented as a single component, or a single "portion", "part", "module", "member" or "block" may include a plurality of components.

It will be understood that when a certain part is referred to as being "connected" to another part, it can be directly or indirectly connected to the other part. When a part is indirectly connected to another part, it may be connected to the other part through a wireless communication network.

Also, it will be understood that when the terms "includes," "comprises," "including," and/or "comprising," when used in this specification, specify the presence of a stated component, but do not preclude the presence or addition of one or more other components unless the context clearly dictates otherwise.

It will be understood that, although the terms first, second, etc. may be used herein to describe various components, these components should not be limited by these terms. These terms are only used to distinguish one component from another.

It is to be understood that the singular forms "a," "an," and "the" include plural referents unless the context clearly dictates otherwise.

Reference numerals used in operations are provided for convenience of description, without describing the order of the operations, and the operations can be executed in a different order from the stated order unless a specific order is definitely specified in the context.

Throughout the disclosure, the expression "at least one of a, b or c" indicates only a, only b, only c, both a and b, both a and c, both b and c, all of a, b, and c, or variations thereof.

A dryer is an apparatus for supplying hot and dry air to a drying space in which a drying material is accommodated to dry the drying material, wherein the drying material includes all kinds of materials capable of being dried by hot air. For example, the drying material may be various kinds of fibres or fabrics, such as cloth, clothes, towels, and blankets.

The dryer is classified into a heater type, a heat pump type, and a hybrid type using both a heater and a heat pump, according to heat sources for heating air.

Therefore, it is an aspect of the disclosure to provide a dryer of obtaining information about a drying load based on inside humidity of a drum caused by a drying material and current of a motor for rotating the drum, and controlling at least one of a revolutions per minute (rpm) of the motor, a frequency of a compressor, or a degree of superheat of an evaporator based on the obtained information, and a method of controlling the dryer.

Also, it is another aspect of the disclosure to provide a dryer of controlling finishing of a drying process based on inside humidity of a drum and an opening degree of a valve in a heat pump upon a drying process, and a method of controlling the dryer.

The current embodiment will describe a dryer of a heat pump type, as an example.

Hereinafter, an operation principle and embodiments of the disclosure will be described with reference to the accompanying drawings.

Figure 2:
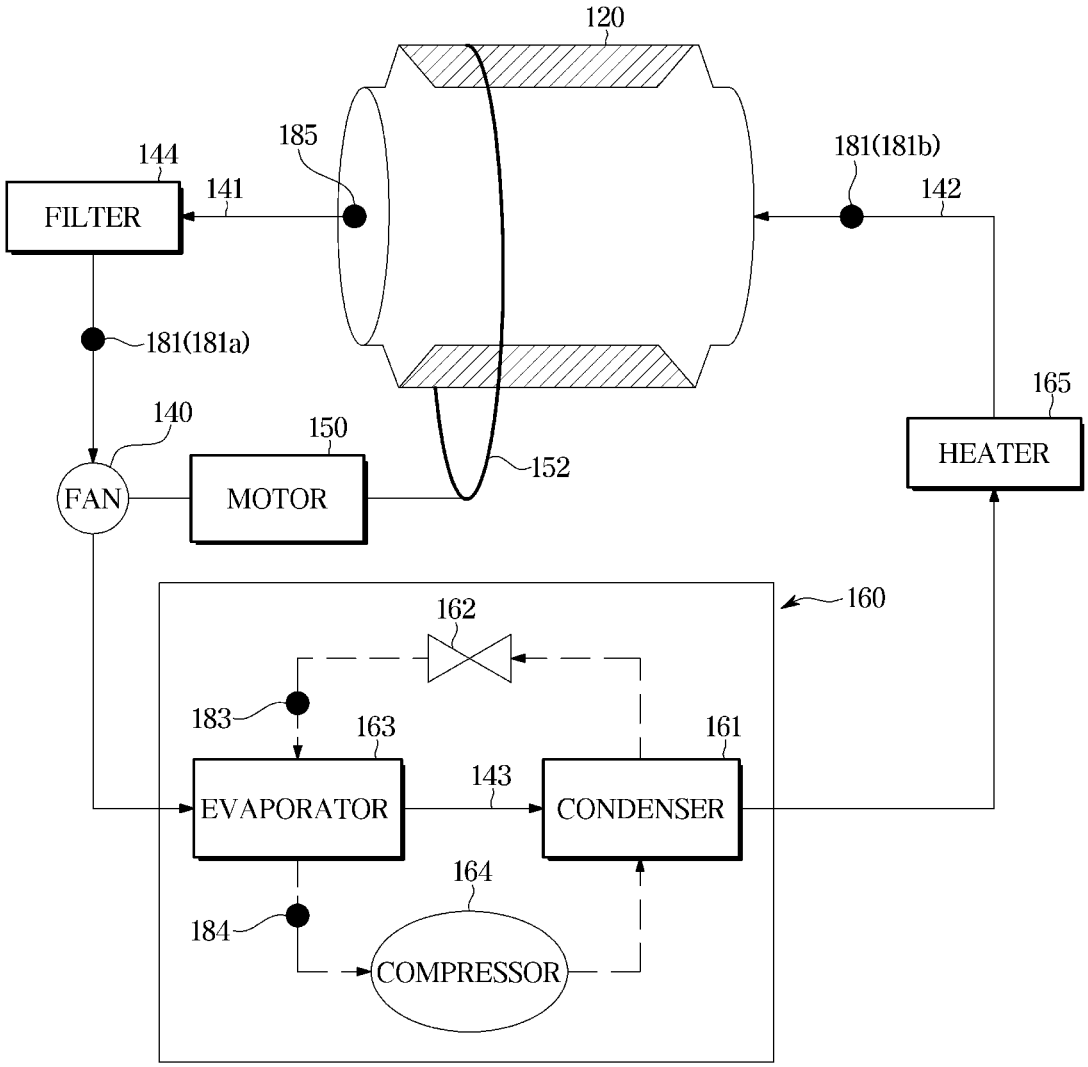
FIG. 2 shows an example of a heat pump in a dryer according to an embodiment of the disclosure.

FIG. 1 is a cross-sectional view of a dryer according to an embodiment of the disclosure, and FIG. 2 is a configuration view of a heat pump provided in a dryer according to an embodiment of the disclosure.

A dryer 100 may include a main body 110 forming an outer appearance, a drum 120 provided inside the main body 110, a door 130 provided on an outer side of the main body 110, a fan 140 provided inside the main body 110 to circulate air between inside and outside of the drum 120, a motor 150 provided inside the main body 110 to transfer a rotating force for rotating the drum 120 and the fan 140, and a heat pump 160 provided inside the main body 110 to generate hot air.

The main body 110 may be in a shape of a rectangular parallelepiped extending in a up-down direction. However, the shape of the main body 110 is an example for convenience of description, and the main body 110 may be implemented in various shapes.

The main body 110 may accommodate the drum 120, a driving assembly and a drying assembly. In a front side of the main body 110, an opening may be formed. The opening may be positioned to correspond to an opening of the drum 120, and may be shaped to correspond to the opening of the drum 120.

A user may put a drying material into the drum 120 or take the drying material out of the drum 120, through the opening of the main body 110.

On the main body 110, a user interface 170 may be provided.

The user interface 170 may include an inputter to enable the user to input a control command for operating the dryer 100, and a display for displaying operation information of the dyer 100.

The inputter may receive various user inputs for operating the dryer 100. The inputter may be implemented as one of various types, such as a pressing button, a switch, a key, and a dial. The inputter may enable the user to select an operation process (also, referred to as an operation course) of the dryer 100. The operation process may be a drying process.

The display may display operation information of the dryer 100 as a visual image. In this case, the display may be a touch screen capable of receiving a user's control commands. The drum 120 may rotate in a clockwise or counterclockwise direction inside the main body 110 by a driving force of the motor 150.

The drum 120 may be rotatable inside the main body 110. The drum 120 may rotate in the clockwise or counterclockwise direction inside the main body 110 by a rotating force of the motor 150.

The drum 120 may include a drying space connected to the opening of the main body 110, and accommodate a drying material. The drum 120 may rotate to move the drying material therein. In this case, the drying material put into the drying space (not shown) of the drum 120 through the opening of the main body 110 may be dried by hot air that is supplied to the drying space (not shown).

On an inner circumferential surface of the drum 120, a plurality of lifters 121 may be provided to lift the drying material. The plurality of lifters 121 may protrude from the inner circumferential surface of the drum 120.

The drum 120 may include an intake port 122 positioned at a rear side of the drum 120 to inhale hot air, and an exhaust port 123 positioned at a lower portion of the front side of the drum 120 to discharge air containing moisture to the outside of the drum 120.

A detector 181 (see FIG. 2) for detecting at least one of temperature or humidity of the drying material accommodated in the drum 120 may be positioned around at least one of the intake port 122 or the exhaust port 123 of the drum 120.

The door 130 may be pivoted from the front side of the main body 110 to open and close the opening formed in the front side of the main body 110. The door 130 may seal the drying space formed inside the drum 120.

More particularly, a hinge may be positioned at a portion of the front side of the main body 110, the portion being adjacent to the door 130. In this case, the door 130 may be connected to the hinge and rotate on the hinge to thus open and close the opening of the main body 110. The door 130 may be in a shape of a circle corresponding to the shape of the opening, and may have a greater diameter than the opening. That is, the door 130 may contact a surface forming the opening of the main body 110 to close the opening, or may be separated from the surface forming the opening of the main body 110 to open the opening.

The fan 140 may inhale hot and dry air existing inside the drum 120, and supply air heat-exchanged in the heat pump 160 to the inside of the drum 120. The fan 140 may be positioned inside a fan housing 140*a*.

The dryer 100 may include an exhaust flow passage 141 connecting the drum 120 to the fan housing 140*a* and forming a flow passage for moving inside air of the drum 120 to inside of the fan housing 140*a*, an air-supply flow passage 142 connecting the heat pump 160 to the drum 120 and forming a flow passage for moving high-temperature air generated in the heat pump 160 to the inside of the drum 120, and a heat-exchange flow passage 143 positioned between the exhaust flow passage 141 and the air-supply flow passage 142 and forming a flow passage in which heat-exchanging of air occurs and along which the heat-exchanged air moves. In addition, the air-supply flow passage 142 may include an inlet through which air is supplied from the outside of the main body 110 and an outlet through which a part of the heat-exchanged air is discharged to the outside of the main body 110.

The dryer 100 may further include a filter 144 for collecting various foreign materials such as lint included in air discharged from the drum 120 to the exhaust flow passage 141. The filter 144 may be positioned at an entrance of the exhaust flow passage 141, more particularly, at a connection portion in which the entrance of the exhaust flow passage 141 is connected to the drum 120. The dryer 100 may purify air generated during a drying process through the filter 144 and discharge the purified air to the exhaust flow passage 141.

The motor 150 may rotate and transfer a rotating force generated by the rotation to the drum 120. By adjusting a rpm of the motor 150, a rpm of the drum 120 may be adjusted.

To transfer the rotating force of the motor 150 to the drum 120, the dryer 100 may further include a pulley 151 rotating by receiving power of the motor 150, and a belt 152 rotating the drum 120 while rotating by the rotation of the pulley 151. The belt 152 may be wound around an outer surface of the pulley 151 and an outer surface of the drum 120. Accordingly, the pulley 151 may rotate according to driving of the motor 150 to rotate the drum 120.

Also, the motor 150 may be directly connected to the drum 120 to itself transfer a rotating force to the drum 120.

The motor 150 may transfer a rotating force to the fan 140. In this case, a shaft of the motor 150 may extend at both sides. That is, one side of the shaft of the motor 150 may be connected to the pulley 151, and the other side of the shaft of the motor 150 may be connected to the fan 140.

The motor 150 may transfer a rotating force to the fan 140 to rotate the fan 140. Thereby, the motor 150 may tumble a drying material put into the drying space (not shown) inside the drum 120, while uniformly applying hot air to the drying material through the fan 140.

The dryer 100 may include a fan motor (not shown) for driving the fan 140, and a drum motor (not shown) for drying the drum 120. That is, the fan motor and the drum motor may be provided separately inside the dryer 100.

The dryer 100 may include a heat source for drying a drying material accommodated in the drum 120. The heat source may include a heat pump, a heater, or both a heat pump and a heater. The current embodiment relates to the dryer 100 having the heat pump 160 as a heat source.

The heat pump 160 may perform heat-exchange with air circulating inside the main body 110. The heat pump 160 may include a cooling cycle portion for circulating a refrigerant to perform heat-exchange with air discharged from the drum 120 and supplying the heat-exchanged high-temperature air to the inside of the drum 120.

The cooling cycle portion 160*a* may include a condenser 161, an expansion valve 162, an evaporator 163, and a compressor 164. The refrigerant may circulate while performing a series of phase changes of compression-condensation-expansion-evaporation. The condenser 161 and the evaporator 163 may be implemented as a heat exchanger capable of performing heat exchange with air.

The condenser 161 may heat surrounding air. The heated air may move to the inside of the drum 120 through the air-supply flow passage 142. The surrounding air may be air existing inside the main body 110 or air entered from the outside of the main body 110.

The condenser 161 may be connected to the compressor 164 and condense a refrigerant compressed by the compressor 164 into a liquid refrigerant. At this time, the condenser 161 may emit heat to the surroundings through a condensing process.

The expansion valve 162 may adjust a pressure difference of the refrigerant to expand the liquid refrigerant being in a high-temperature and high-pressure state and condensed by the condenser 161 into a liquid refrigerant being in a low-pressure state. The expansion valve 162 may be an electronic expansion valve (EEV) of which an opening degree changes through an electrical signal. The expansion valve 162 may adjust a flow rate of the refrigerant by adjusting the opening degree.

Also, the cooling cycle portion may include a capillary tube for expanding the liquid refrigerant into the liquid refrigerant being in the low-pressure state.

The expansion valve 162 may adjust the flow rate of the refrigerant to adjust a degree of superheat which is a temperature difference between temperature at an entrance of the evaporator 163 and temperature at an exit of the evaporator 163.

Also, the expansion valve 162 may adjust temperature of the refrigerant discharged from the compressor 164.

The evaporator 163 may evaporate the liquid refrigerant being in the low-temperature and low-pressure state and entered through the expansion valve 164, and supply a gas refrigerant being in a low-temperature and low-pressure state and changed through heat exchange to the compressor 164. At this time, the evaporator 163 may take away heat from the surroundings through an evaporation process of changing a refrigerant liquid into a refrigerant gas. That is, the evaporator 163 may condense moisture included in surrounding air to thereby remove moisture from the surrounding air.

In other words, high-temperature and humid air discharged from the drum 120 may be cooled by the evaporator 163, and at this time, moisture included in the air may be condensed to generate condensed water. The condensed water may fall to a bottom of the evaporator 163 to be collected in a water trap (not shown) provided in the bottom of the evaporator 163. The condensed water collected in the water trap may move to a storage or be discharged to the outside of the main body 110.

The compressor 164 may compress the refrigerant into a high-temperature and high-pressure state and discharge the refrigerant. At this time, the refrigerant discharged from the compressor 164 may enter the condenser 161. In this case, the compressor 164 may compress the refrigerant through a reciprocating motion of a piston or a rotation motion of a rotor.

The dryer 100 may further include a heater 165 which is a heat source capable of heating air. The heater 165 may be implemented as a heating coil, although not limited thereto.

The heater 165 may further heat air heat-exchanged by the condenser 162 to raise temperature of the air, and supply the resultant air to the drum 120.

The heater 165 may be an electric heater. For example, the heater 165 may be a heater using a plurality of heating wires to generate heat by transmitting current. Alternatively, the heater 165 may be a positive temperature coefficient (PTC) heater.

The heater 165 may be a gas heater. For example, the heater 165 may include an igniter, and a valve for providing gas to the igniter. The igniter may be heated by receiving power, and, in response to temperature of the igniter reaching preset temperature, the valve may open to supply gas to the igniter. As a result of a contact of the gas to the igniter being at the preset temperature, the igniter may ignite to heat surrounding air.

The heater 165 may apply current to the plurality of heating wires in response to a control command of the controller 190, or adjust a supply amount of gas to adjust an amount of thermal energy to be transferred to air.

The dryer 100 may include a first detector 181 positioned on at least one of the exhaust flow passage 141 or the air-supply flow passage 142 to detect humidity of a drying material accommodated in the drum 120.

The first detector 181 may include a temperature-humidity sensor to detect both temperature and humidity.

The dryer 100 may further include a third detector 183 for detecting temperature at the entrance of the evaporator 163, and a fourth detector 184 for detecting temperature at the exit of the evaporator 163.

The dryer 100 may further include a fifth detector 185 for detecting a dryness of a drying material accommodated in the drum 120.

Figure 3:
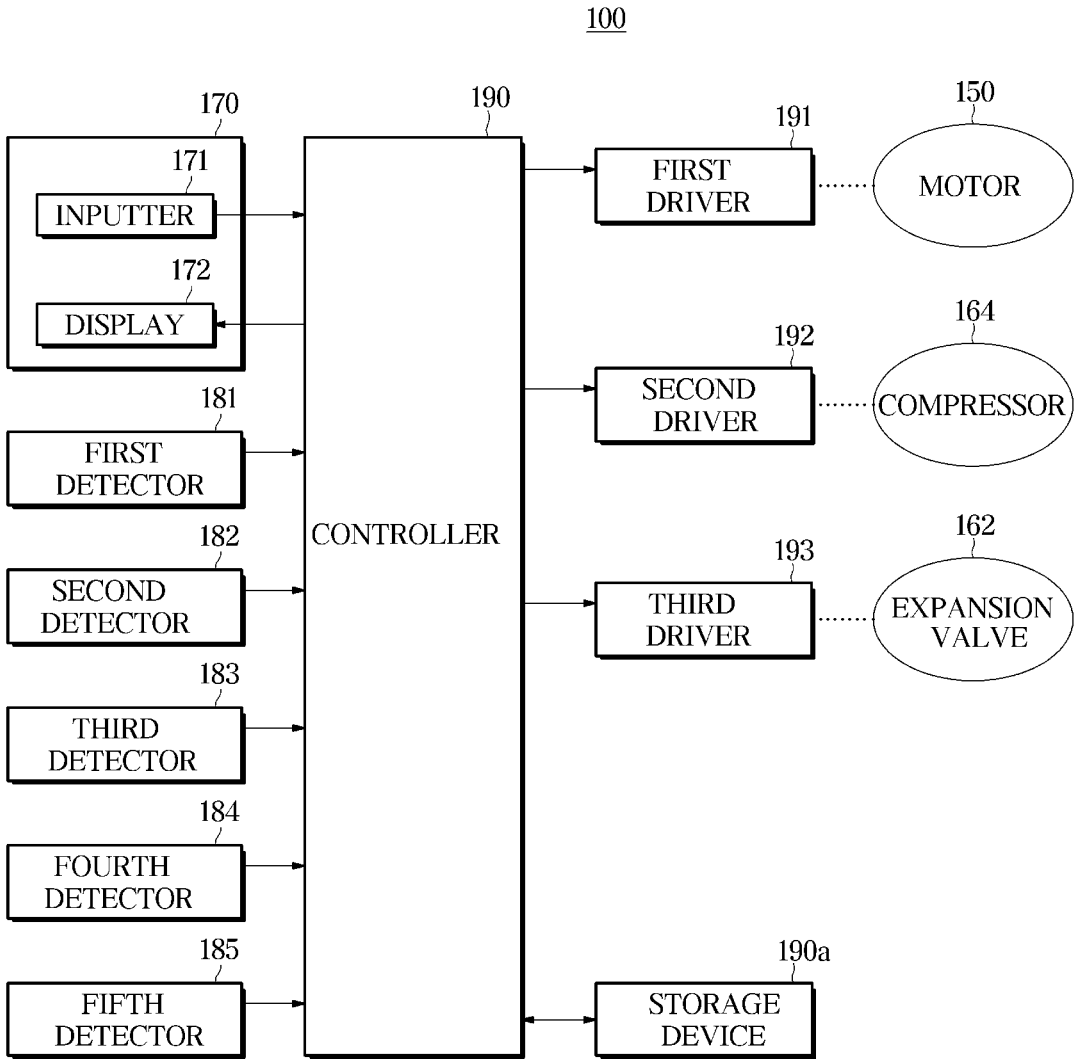
FIG. 3 is a control configuration diagram of a dryer according to an embodiment of the disclosure.
Figure 4:
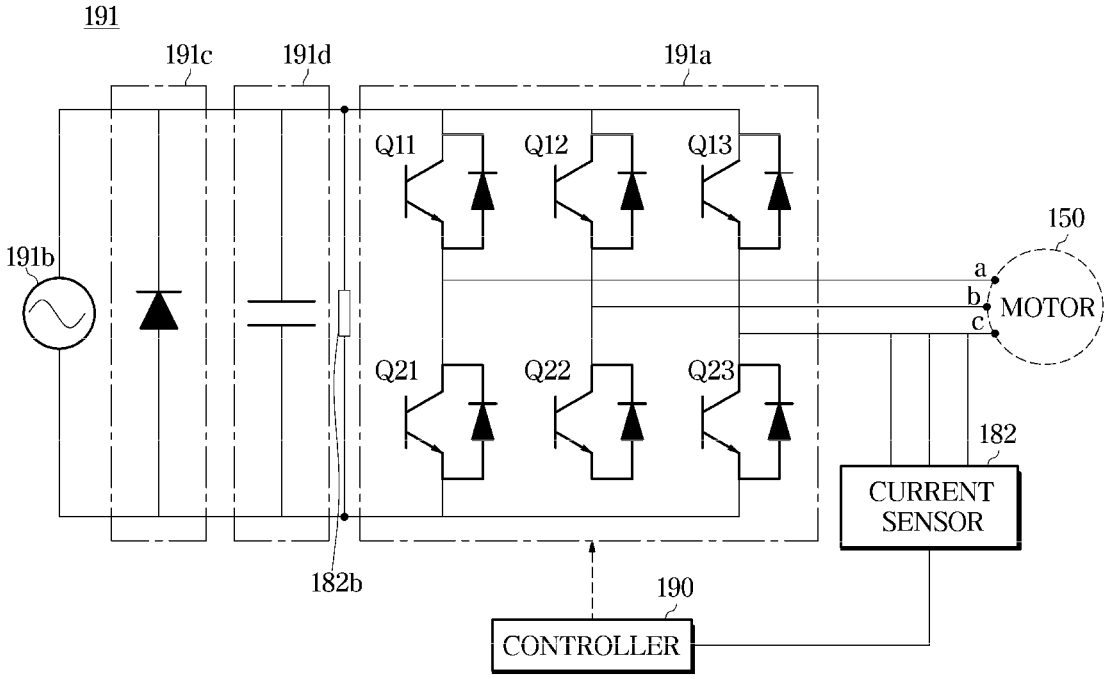
FIG. 4 shows an example of a driver for driving a motor provided in a dryer according to an embodiment of the disclosure.

FIG. 3 is a control configuration diagram of a dryer according to an embodiment of the disclosure, and FIG. 4 shows an example of a driver for driving a motor provided in a dryer according to an embodiment of the disclosure.

As shown in FIG. 3, the dryer 100 may include a user interface 170, a plurality of detectors 181 to 185, a controller 190, a storage device 190*a*, and a plurality of drivers 191 to 193.

The user interface 170 may include an inputter 171 for receiving user inputs, and a display 172 for displaying operation information of the dryer 100 and displaying input information corresponding to a user input.

The user input may include a target dryness.

For example, the target dryness may include a preset dryness programmed in the dryer 100, and may include a first dryness, a second dryness, and a third dryness set by a user. The first dryness may be a Normal dry, the second dryness may be a More dry, and the third dryness may be a Very dry. The Normal dry may correspond to a lowest dryness, and the Very dry may correspond to a highest dryness. That is, the More dry may correspond to a value between the dryness of the Normal dry and the dryness of the Very dry.

Also, the user input may be a dry start command, a pause command, or a dry finish command.

The display 172 may display at least one dryness selected by a user. The display 172 may display a preset dryness.

The display 172 may display information about a drying load, a total drying time, and a remaining drying time. The display 172 may display additional time for a secondary drying process.

The display 172 may display inside temperature (that is, dry temperature) of the drum 120.

The plurality of detectors 181 to 185 may directly or indirectly detect a state of a drying material in the drum 120, and detect an operation state of the heat pump 160.

The first detector 181 may be a humidity sensor positioned on the air-supply flow passage 142 to detect humidity of air to be supplied to the drum 120. The first detector 181 positioned on the air-supply flow passage 142 may be a temperature-humidity sensor for detecting both temperature and humidity.

The first detector 181 may be a humidity sensor positioned on the exhaust flow passage 141 to detect humidity of air discharged from the drum 120. The first detector 181 positioned on the exhaust flow passage 141 may be a temperature-humidity sensor for detecting both humidity and temperature.

The first detector 181 may include a first humidity sensor positioned on the air-supply flow passage 142 to detect humidity of air to be supplied to the drum 120, and a second humidity sensor positioned on the exhaust flow passage 141 to detect humidity of air discharged from the drum 120. The first detector 181 provided on each of the air-supply flow passage 142 and the exhaust flow passage 141 may be a temperature-humidity sensor for detecting both temperature and humidity.

In the current embodiment, the first detector 181 may be a humidity sensor positioned on the exhaust flow passage 141.

The second detector 182 may detect an electrical signal applied to the motor 150 to recognize operation information of the motor 150, and output the detected electrical signal.

The second detector 182 may be a current sensor connected to the motor 150 to detect current applied to the motor 150.

The operation information of the motor 150 may include at least one of current applied to the motor 150, a voltage applied to the motor 150, or power of the motor 150. That is, the electrical signal may include at least one of a current signal, a voltage signal, or a power signal.

The second detector 182 may be a current sensor for detecting current applied to the motor 150. The current sensor may detect current applied to the motor 150 through at least one input terminal of 3-phase input terminals of the motor 150, provided in a first driver 191 (see FIG. 3), and output a signal corresponding to the detected current. The signal may correspond to a value of the current applied to the motor 150.

The second detector 182 may be a voltage sensor (see FIG. 4) for detecting a voltage applied to both terminals of the motor 150. The voltage sensor may detect a DC voltage at both terminals of a DC voltage source provided in the first driver 191.

The second detector 182 may be used to detect power of the motor 150, and may include both a current sensor for detecting current applied to the motor 150 and a voltage sensor for detecting a voltage applied to both terminals of the motor 150.

The third detector 183 and the fourth detector 184 may be sensors for obtaining information about a degree of superheat of the evaporator 163. That is, the third detector 183 may be a temperature sensor positioned at the entrance or exit of the evaporator 163 to detect temperature at the entrance or exit of the evaporator 163, and the fourth detector 184 may be a pressure sensor positioned at the exit of the evaporator 163 to detect pressure at the exit of the evaporator 163.

The fifth detector 185 may be an electrode sensor provided in the drum 120 to detect a dryness of a drying material accommodated inside the drum 120.

The electrode sensor which is the fifth detector 185 may be positioned at a lower end of the front side of the drum 120, contact a drying material rotating according to a rotation of the drum 120 to detect an electrical signal changing according to an amount of moisture contained in the drying material, and output the electrical signal. The electrical signal may be a signal for determining a dryness of the drying material. Also, the electrical signal may be a signal for detecting humidity of the drying material.

The electrical signal detected by the electrode sensor may be output in a form of a pulse.

The electrode sensor may be in a shape of two plate bars through which current flows by moisture.

The fifth detector 185 may output, in response to a reference voltage applied to the electrode sensor being in the shape of two plate bars, an electrical signal corresponding to current flowing through the two plate bars to which the reference voltage is applied. That is, the electrode sensor may output a current signal, or a voltage signal corresponding to the current signal.

The fifth detector 185 may be a touch sensor being in a shape of a plate bar.

The dryer 100 may further include a temperature sensor for detecting temperature of air for drying a drying material accommodated inside the drum 120. The temperature sensor may be positioned on the exhaust flow passage 141.

Also, the temperature sensor may be positioned around the fan 140. In this case, the temperature sensor may detect temperature of exhausted air and output an electrical signal corresponding to the temperature of the air.

Also, the temperature sensor may be positioned at the lower end of the rear side of the drum 120, that is, on the air-supply flow passage 142, or the temperature sensor may be positioned inside the drum 120 to detect temperature of inside air of the drum 120 and output an electrical signal corresponding to the temperature of the inside air of the drum 120.

The dryer 100, which includes the heater 165, may further include a temperature sensor for detecting temperature of the heater 165 or temperature around the heater 165 to control on/off of the heater 165.

The controller 190 may control overall operations of the dryer 100.

The controller 190 may control operations of the dryer 100 based on a drying load corresponding to an amount of a drying material. The controller 190 may control operations of the dryer 190 based on a dryness input to the inputter 171. The dryness input to the inputter 171 may be a target dryness, or target humidity for determining whether to finish a drying process.

The controller 190 may obtain humidity information of a drying material based on detection information detected by the first detector 181. The humidity information of the drying material may be predicted from humidity of air entered the exhaust flow passage 141. Also, the humidity information of the drying material may be predicted from humidity of air supplied from the air-supply flow passage 142 to the drum 120.

The controller 190 may obtain current information about current flowing through the motor 150 based on detection information detected by the second detector 182, and determine a drying load of the drying material accommodated in the drum 120 based on the current information and the humidity information. For example, the drying load may be classified into a small load, a medium load that is more than the small load, and a large load that is more than the medium load.

The medium load may be an average amount of a drying material accommodated in the drum 120 for one-time use of the dryer 100, and may be determined by an experiment. Also, the medium load may be an average amount for a minimum drying load and a maximum drying load capable of being dried by one-time drying process using the motor 150 and the heat pump 160. The medium load may be a preset amount of load, and may be also referred to as a normal load.

The controller 190 may compare the humidity information to a plurality of pieces of pre-stored reference humidity information, compare the current information to a plurality of pre-stored reference current information, and determine a drying load based on a result of the comparison of the humidity information and a result of the comparison of the current information.

More particularly, the controller 190 may obtain humidity from the humidity information, and obtain current from the current information.

The controller 190 may compare the humidity to first reference humidity, and compare the current to first reference current. In response to the humidity determined to be lower than the first reference humidity and the current determined to be lower than the first reference current, the controller 190 may determine no load representing that no drying material is accommodated in the drum 120.

In response to the humidity determined to be higher than or equal to the first reference humidity and lower than second reference humidity and the current determined to be higher than or equal to the first reference current and lower than second reference current, the controller 190 may determine a drying load to be a small load.

In response to the humidity determined to be higher than or equal to the second reference humidity and lower than third reference humidity and the current determined to be higher than or equal to the second reference current and lower than third reference current, the controller 190 may determine a drying load to be a normal load.

In response to the humidity determined to be higher than the third reference humidity and the current determined to be higher than the third reference current, the controller 190 may determine a drying load to be a large load.

For example, the first reference humidity may be humidity resulting from adding about 10% of predefined humidity to the predefined humidity, the second reference humidity may be humidity resulting from adding about 40% of the predefined humidity to the predefined humidity, and the third reference humidity may be humidity resulting from adding about 70% of the predefined humidity to the predefined humidity.

The first reference current may be current resulting from adding about 5% of predefined current to the predefined current, the second reference current may be current resulting from adding about 10% of the predefined current to the predefined current, and the third reference current may be current resulting from adding about 30% of the predefined current to the predefined current.

The controller 190 may obtain a drying algorithm corresponding to the detected drying load. That is, the controller 190 may obtain at least one of a rpm of the motor 150, a frequency of the compressor 164, or a degree of superheat of the evaporator 163 through the drying algorithm.

The controller 190 may control the rpm of the motor 150 based on the drying algorithm to adjust a rpm of the drum 120 and a rpm of the fan 140.

The controller 190 may control the frequency of the compressor 164 based on the drying algorithm to adjust temperature of air circulating to the inside and outside of the drum 120.

The controller 190 may adjust the degree of superheat of the evaporator 163 based on the drying algorithm to adjust a degree of condensation of moisture in the evaporator 163. Controlling the degree of superheat of the evaporator 163 may be adjusting an opening degree of the expansion valve 162 provided in the heat pump 160.

That is, the controller 190 may control a rpm of the motor 150, a frequency of the compressor 164, and a degree of superheat of the evaporator 163 to correspond to a drying load, thereby adjusting drying capability.

More particularly, in response to a drying load determined to be the medium load, the controller 190 may obtain a drying algorithm corresponding to the medium load, and control driving of the motor 150, the compressor 164, and the expansion valve 162 to perform a drying process based on the drying algorithm. That is, in response to a drying load determined to be the medium load, the controller 190 may control driving of the motor 150 such that the rpm of the motor 150 is maintained at a set rpm, control driving of the compressor 164 such that the frequency of the compressor 164 is maintained at a set frequency, and control driving of the expansion valve 162 such that the degree of superheat of the evaporator 163 is maintained at a set degree of superheat.

In response to a drying load determined to be the small load, the controller 190 may obtain a drying algorithm corresponding to the small load, and control driving of the motor 150, the compressor 164, and the expansion valve 162 such that a drying process is performed based on the drying algorithm.

That is, in response to a drying load determined to be the small load, the controller 190 may control driving of the motor 150 such that the rpm of the motor 150 decreases to be smaller than the set rpm, control driving of the compressor 164 such that the frequency of the compressor 164 decreases to be lower than the set frequency, and control driving of the expansion valve 162 such that the degree of superheat of the evaporator 163 increases to be higher than the set degree of superheat.

A decrease amount of the rpm of the motor 150, a decrease amount of the frequency of the compressor 164, and an increase amount of the degree of superheat may have been set in advance.

Increasing the degree of superheat may be aimed to reduce an amount of a refrigerant circulating in the cooling cycle portion 160*a*.

Decreasing the rpm of the motor 150 may be aimed to reduce an amount of air circulating through the fan 140. Also, decreasing the rpm of the motor 150 may be aimed to reduce the number of tumbling operations of a drying material inside the drum 120.

Decreasing the frequency of the compressor 164 may be aimed to reduce a load of the compressor 164.

Also, in response to the drying load determined to be the small load, the controller 190 may determine a decrease amount of the rpm of the motor 150, a decrease amount of the frequency of the compressor 164, and an increase amount of the degree of superheat, based on the drying load.

For example, in response to a drying load determined to be a first small load, the controller 190 may control driving of the motor 150 such that the rpm of the motor 150 is smaller by a first decrease amount than the set rpm, control driving of the compressor 164 such that the frequency of the compressor 164 is lower by a first decrease amount than the set frequency, and control an opening degree of the expansion valve 162 such that the degree of superheat is greater by a first increase amount than the set degree of superheat.

In response to a drying load determined to be a second small load, the controller 190 may control driving of the motor 150 such that the rpm of the motor 150 is smaller by a second decrease amount than the set rpm, control driving of the compressor 164 such that the frequency of the compressor 164 is lower by a second decrease amount than the set frequency, and control an opening degree of the expansion valve 162 such that the degree of superheat is greater by a second increase amount than the set degree of superheat.

Herein, the second small load may be less than the first small load, the second decrease amount of the rpm of the motor 150 may be greater than the first decrease amount of the rpm of the motor 150, the second decrease amount of the frequency of the compressor 164 may be greater than the first decrease amount of the frequency of the compressor 164, and the second increase amount of the degree of superheat may be greater than the first increase amount of the degree of superheat.

That is, in response to the drying load determined to be the small load, the controller 190 may further decrease the rpm of the motor 150, further decrease the frequency of the compressor 164, and further increase the degree of superheat, as the amount of the drying load decreases.

In response to a drying load determined to be the large load, the controller 190 may obtain a drying algorithm corresponding to the large load, and control driving of the motor 150, the compressor 164, and the expansion valve 162 to perform a drying process based on the drying algorithm.

That is, in response to a drying load determined to be the large load, the controller 190 may control driving of the motor 150 such that the rpm of the motor 150 increases to be greater than the set rpm, control driving of the compressor 164 such that the frequency of the compressor 164 increases to be higher than the set frequency, and control the opening degree of the expansion valve 162 such that the degree of superheat of the evaporator 163 decreases to be smaller than the set degree of superheat.

An increase amount of the rpm of the motor 150, an increase amount of the frequency of the compressor 164, and a decrease amount of the degree of superheat may have been set in advance.

Decreasing the degree of superheat may be aimed to increase an amount of a refrigerant circulating in the cooling cycle portion 160*a*.

Increasing the rpm of the motor 150 may be aimed to increase an amount of air circulating through the fan 140. Also, increasing the rpm of the motor 150 may be aimed to increase the number of tumbling operations of a drying material inside the drum 120.

Increasing the frequency of the compressor 164 may be aimed to increase a load of the compressor 164 to raise temperature of heat generated in the condenser 161, thereby increasing temperature of air for drying.

Also, in response to the drying load determined to be the large load, the controller 190 may determine an increase amount of the rpm of the motor 150, an increase amount of the frequency of the compressor 164, and a decrease amount of the degree of superheat, based on the drying load. In this case, in response to the drying load determined to be the large load, the controller 190 may further increase the rpm of the motor 150, further increase the frequency of the compressor 164, and further decrease the degree of superheat, as the amount of the drying material increases.

To control the degree of superheat of the evaporator 163, the controller 190 may obtain information about a degree of superheat of the evaporator 163, based on temperature information of the evaporator 163, detected by the third detector 183, and pressure information of the evaporator 163, detected by the fourth detector 184, and control an opening degree of the expansion valve 162 based on the information about the degree of superheat.

Herein, the degree of superheat may be a difference between temperature of superheated steam heated to above saturation temperature and saturation temperature corresponding to pressure of the superheated steam. The controller 190 may obtain saturation temperature from detected pressure information of the evaporator 163, obtain a temperature difference between detected superheating temperature of the evaporator 163 and the saturation temperature, obtain information about an opening degree corresponding to the temperature difference, and control an operation of the expansion valve 162 based on the information about the opening degree.

The controller 190 may perform a control operation of increasing the opening degree of the expansion valve 162 to decrease the degree of superheat of the evaporator 163, and perform a control operation of decreasing the opening degree of the expansion valve 162 to increase the degree of superheat of the evaporator 163.

To control driving of the motor 150, the controller 190 may estimate a position of the rotor based on a voltage instruction and current detected by the second detector 182, obtain a rpm of the motor 150 based on the estimated position of the rotor, obtain target current based on a result of comparison between the rpm of the motor 150 and a target rpm, and control current to be applied to the motor 150 based on the target current and the detected current, thereby controlling the rpm of the motor 150.

During a drying process, the controller 190 may rotate the drum 120 and the fan 140 through driving of the motor 150 to cause a drying material accommodated in the drum 120 to tumble and inside air of the drum 120 to circulate.

The controller 190 may determine whether to finish the drying process based on humidity information detected by the first detector 181.

The controller 190 may determine whether to finish the drying process based on an opening degree of the expansion valve 161 and a target opening degree.

The controller 190 may determine whether to finish the drying process based on humidity information detected by the first detector 181 and information about an opening degree of the expansion valve 161.

In response to a drying load determined to be the small load, the controller 190 may check a drying time while performing a drying process, determine whether the drying time reaches a set time, obtain humidity information based on detection information detected by the first detector 181 in response to the drying time reaching the set time, and determine whether to finish the drying process based on humidity corresponding to the humidity information and target humidity. That is, in response to detected humidity determined to be the target humidity, the controller 190 may finish the drying process, and, in response to detected humidity determined to exceed the target humidity, the controller 190 may continue to perform the drying process, and finish the drying process at a drying time that reaches a first dry finish time.

The drying time may be an elapsed time from a start time of the drying process to a current time.

The set time may be a time set to check a dryness of a drying material while a drying process is performed, and may be a time that is earlier by a predefined time than the first dry finish time.

The first dry finish time may be a dry finish time corresponding to the small load.

In response to a drying load determined to be the medium load or the large load, the controller 190 may obtain information about a dryness of a drying material based on detection information detected by the fifth detector 185, and control additional drying based on the information about the dryness.

To obtain the information about the dryness of the drying material, the controller 190 may count the number of electrical signals received for a preset time period, obtain a pulse value corresponding to the count number of electrical signals, and obtain a dryness of the drying material based on the pulse value. Herein, the electrical signals may be pulse signals, and the preset time may be one minute.

Also, the counted electrical signals may be pulse signals having values that are greater than a reference value. For example, the counted electrical signals may be pulse signals having current values that are greater than a reference current value or pulse signals having voltage values that are greater than a reference voltage value.

That is, the controller 190 may obtain information about a dryness of the drying material based on the obtained pulse value, obtain the dryness of the drying material from the information about the dryness, check a drying time in response to the dryness determined to be a reference dryness, obtain additional time information based on the checked drying time, and control additional drying based on the additional time information. In this case, the dry finish time may be extended.

Herein, the drying time may be an elapsed time between a reception time of a dry start command and a time at which the obtained dryness reaches the reference dryness.

The controller 190 may multiply the drying time by a predefined coefficient to obtain an additional time. That is, as the drying time is longer, the additional time may also be more lengthened.

Even though the drying time is shorter than or equal to a preset time, a dryness of the drying material may reach the reference dryness. In this case, the controller 190 may maintain the dry finish time.

While the dry finish time is maintained, the controller 190 may obtain humidity information based on detection information detected by the first detector 181 during a drying process, determine whether detected humidity is target humidity based on the humidity information and target humidity information, perform a control operation of finishing the drying process in response to the detected humidity determined to be the target humidity, perform a control operation of maintaining the drying process in response to detected humidity determined to exceed the target humidity, and perform a control operation of finishing the drying process at a drying time that reaches the dry finish time while the drying process is maintained.

As a result of extension of the dry finish time, the controller 190 may perform additional drying based on an added time, obtain humidity information based on detection information detected by the first detector 181 while performing the additional drying, determine whether detected humidity is the target humidity based on the humidity information and the target humidity information, perform a control operation of finishing the drying process in response to detected humidity determined to be the target humidity, maintain the drying process in response to detected humidity determined to exceed the target humidity, and perform a control operation of finishing the drying process at a drying time that reaches the extended dry finish time while the drying process is maintained.

In addition, the controller 190 may determine that the detected humidity exceeds the target humidity even though the drying time reaches the extended dry finish time. In this case, the controller 190 may maintain the drying process until a maximum dry finish time, and perform a control operation of finishing the drying process at a drying time that reaches the maximum dry finish time.

While the dry finish time is maintained, the controller 190 may check an opening degree of the expansion valve 162, and, in response to an opening degree of the expansion valve 162 determined to be a target opening degree, the controller 190 may perform a control operation of finishing the drying process.

As a result of extension of the dry finish time due to additional drying, the controller 190 may check an opening degree of the expansion valve 162 while performing additional drying, and in response to the opening degree of the expansion valve 162 that reaches the target opening degree, the controller 190 may perform a control operation of finishing the drying process.

The controller 190 may be implemented with a memory (not shown) that stores algorithms for controlling the operations of components in the dryer 100 or data for programs for executing the algorithms, and a processor (not shown) that performs the above-described operations using the data stored in the memory. The memory and the processor may be implemented as separate chips. Alternatively, the memory and the processor may be integrated into a single chip.

The storage device 190*a* may store a drying algorithm capable of being performed by the dryer 100.

The storage device 190*a* may store information about a set rpm of the motor 150, a set frequency of the compressor 164, and a set degree of superheat of the evaporator 163, and store information about first, second, and third reference current and first, second, and third reference humidity for determining a drying load.

The storage device 190*a* may store information about a decrease amount of a frequency of the compressor 164, a decrease amount of a rpm of the motor 150, and an increase amount of a degree of superheat of the evaporator 163, corresponding to the small load, and store information about an increase amount of a frequency of the compressor 164, an increase amount of a rpm of the motor 150, and a decrease amount of a degree of superheat of the evaporator 163, corresponding to the large load.

The storage device 190*a* may store information about a frequency of the compressor 164, a rpm of the motor 150, and a degree of superheat of the evaporator 163, corresponding to the small load, and store information about a frequency of the compressor 164, a rpm of the motor 150, and a degree of superheat of the evaporator 163, corresponding to the large load.

The storage device 190*a* may store information about a minimum dry finish time and a maximum dry finish time for drying a drying material, and the storage device 190*a* may store information about a dry finish time for drying the small load, a dry finish time for drying the medium load, and a dry finish time for drying the large load.

The storage device 190*a* may be implemented as at least one of a non-volatile memory device (for example, a cache, Read Only Memory (ROM), Programmable ROM (PROM), Erasable Programmable ROM (EPROM), Electrically Erasable Programmable ROM (EEPROM), and flash memory), a volatile memory device (for example, Random Access Memory (RAM)), or a storage medium, such as Hard Disk Drive (HDD) and Compact Disc Read Only Memory (CD-ROM), although not limited to these. The storage device 190*a* may be a memory implemented as a separate chip from the processor described above in regard of the controller 190, or the storage device 190*a* and the processor may be integrated into a single chip.

The first driver 191 may drive the motor 150 at a rpm corresponding to a control command of the controller 190.

The motor 150 may be connected to the drum 120 and the fan 140, and output a rotating force for rotating the drum 120 and the fan 140. That is, the motor 150 may generate a driving force from power of an external power source, and transfer the generated driving force as a rotating force to the drum 120 and the fan 140 through a rotating shaft.

The first driver 191 may drive the motor 150 based on a control command of the controller 190. The first driver 191 may include an inverter. That is, the first driver 191 may include an inverter for generating driving current of the motor 150 according to a control command of the controller 190, such that the motor 150 generates a driving force.

The first driver 191 may turn on/off a plurality of switching devices Q11 to Q13 and Q21 to Q23 of the inverter based on a control signal VPWM output from the controller 190. The first driver 191 will be described with reference to FIG. 4, below.

As shown in FIG. 4, the first driver 191 may further include a power source 191*b*, a rectifier 191*c*, and a smoothing portion 191*d*, in addition to the inverter 191*a*.

The power source 191*b* may be connected to an external power supply (not shown) to receive commercial alternating current (AC) power from the external power supply and transfer the commercial AC power to the rectifier 191*c*.

The rectifier 191*c* may include at least one diode, rectify the AC power received from the power source 191*b*, and transfer the rectified power to the smoothing portion 191*d*.

The smoothing portion 191*d* may include at least one capacitor, smooth the power transferred from the rectifier 191*c* to lower pulsating current of the current of the power rectified by the rectifier 191*c*, convert the power into direct current (DC) power having a predefined magnitude for driving the motor 150, and transfer the DC power to the inverter 191*a*.

The inverter 191*a* of the first driver 191 may apply a driving voltage corresponding to a voltage instruction to the motor 150, and supply current corresponding to a current instruction to the motor 150.

The inverter 191*a* may include the plurality of switching devices Q11 to Q13 and Q21 to Q23 for converting the DC power transferred from the smoothing portion 191*d* into 3-phase AC power.

The plurality of switching devices Q11 to Q13 and Q21 to Q23 of the inverter 191*a* may be respectively driven according to a control command of the controller 190 to modulate a pulse width to be transferred to the motor 150.

The plurality of switching devices Q11 to Q13 and Q21 to Q23 of the inverter 191*a* may include three upper switching devices Q11 to Q13 and three lower switching devices Q21 to Q23.

The three upper switching devices Q11 to Q13 may be respectively connected in series to the three lower switching devices Q21 to Q23. That is, a first upper switching circuit Q11 may be connected in series to a first lower switching circuit Q21 on a U terminal, a second upper switching circuit Q12 may be connected in series to a second lower switching circuit Q22 on a V terminal, and a third upper switching circuit Q13 may be connected in series to a third lower switching circuit Q23 on a W terminal. Also, a diode may be connected in parallel to the U terminal, the V terminal, and the W terminal.

Also, three nodes at which the three upper switching circuits Q11 to Q13 are respectively connected to the three lower switching circuits Q21 to Q23 may be respectively connected to three input terminals a, b, and c of the motor 150. Accordingly, current may be supplied to the motor 150 through the three input terminals a, b, and c.

A voltage sensor 182*b* of the dryer 100 may be connected to both terminals of the smoothing portion 191*d* that outputs a DC voltage. The voltage sensor 182*b* may detect the DC voltage.

The second driver 192 and the third driver 193 may operate the heat pump 160 to generate a heat source for heating inside air of the drum 120 in response to a control command of the controller 190. That is, the second driver 192 may operate the compressor 164 in response to a control command of the controller 190, and the third driver 193 may operate the expansion valve 162 in response to a control command of the controller 190.

The second driver 192 may adjust a frequency of the compressor 164 in response to a control command of the controller 190.

The third driver 193 may adjust an opening degree of the expansion valve 162 by opening or closing the expansion valve 192 in response to a control command of the controller 190.

Figure 5:
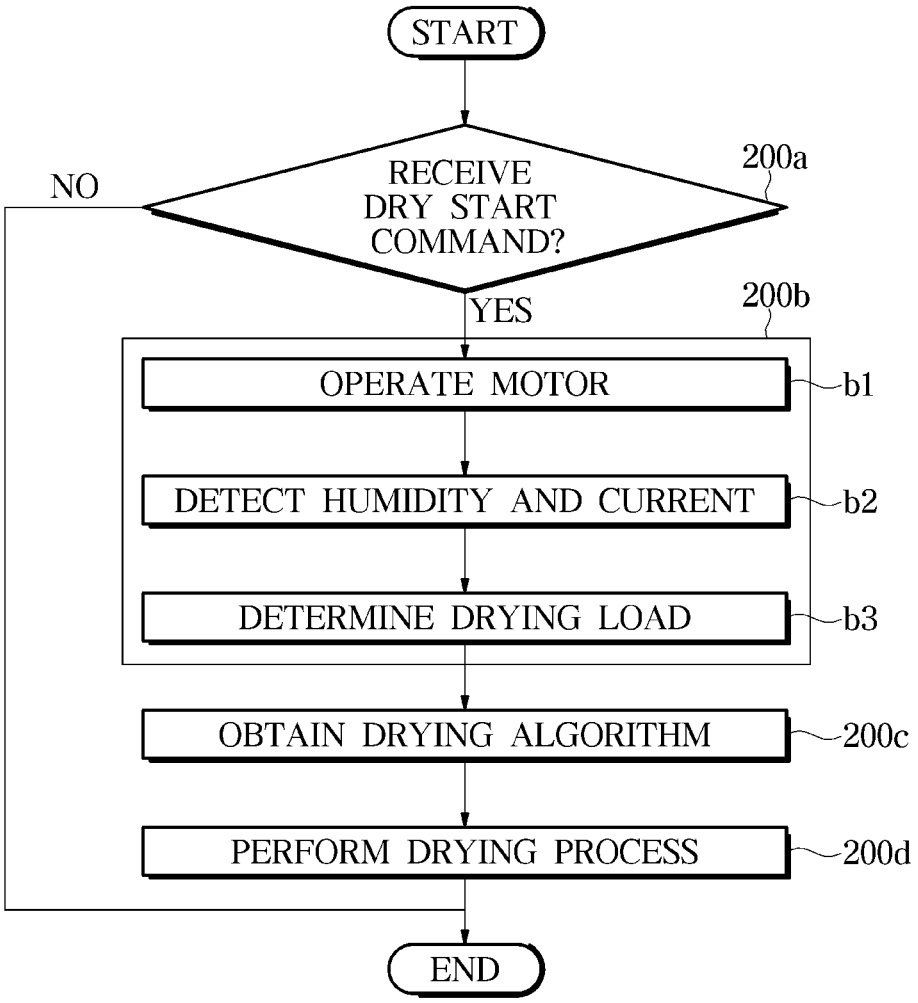
FIG. 5 is a control flowchart of a dryer according to an embodiment of the disclosure.

FIG. 5 is a control flowchart of a dryer according to an embodiment of the disclosure.

In response to reception of a door close signal after a drying material is put into the inside of the drum 120, the dryer 100 may perform a dry standby mode and activate the user interface 170.

In response to a dry start command received through the inputter 171 of the user interface 170 in operation 200*a*, the dryer 100 may perform an operation 200*b* for determining a drying load. Also, the dryer 100 which is communicable may receive a dry start command through a communicator.

The operation 200*b* for determining a drying load may include an operation b1 of operating the motor 150, an operation b2 of detecting current flowing through the motor 150 while the motor 150 operates and detecting humidity formed in the drum 120 by the drying material, and an operation b3 of comparing current information about the detected current to reference current information and comparing humidity information about the detected humidity to reference humidity information to determine a drying load.

The operation b1 of operating the motor 150 may include rotating the drum 120 by a rotating force of the motor 150 and tumbling the drying material inside the drum 120 by the rotation of the drum 120. Also, the dryer 100 may operate the motor 150 for a preset time.

The first detector 181 provided in the dryer 100 may output the humidity information about the detected humidity as detection information, and the second detector 182 may output the current information about the detected current as detection information.

Herein, the humidity formed in the drum 120 by the drying material may be estimated from humidity of air entered the exhaust flow passage 141. Also, the humidity formed in the drum 120 by the drying material may be estimated from humidity of air supplied from the air-supply flow passage 142 to the drum 120.

The dryer 100 may obtain a drying algorithm corresponding to the drying load, in operation 200*c*, and perform a drying process based on the drying algorithm, in operation 200*d*.

The operation 200*c* of obtaining the drying algorithm may include an operation of obtaining a rpm of the motor 150, a frequency of the compressor 164, and a degree of superheat of the evaporator 163, corresponding to the drying load. The rpm of the motor 150, the frequency of the compressor 164, and the degree of superheat of the evaporator 163 may increase, decrease, or be maintained based on a set rpm, a set frequency, and a set degree of superheat.

The control configuration of the dryer 100 will be described in detail with reference to FIGS. 6A, 6B, and 6C, below.

Figure 6A:
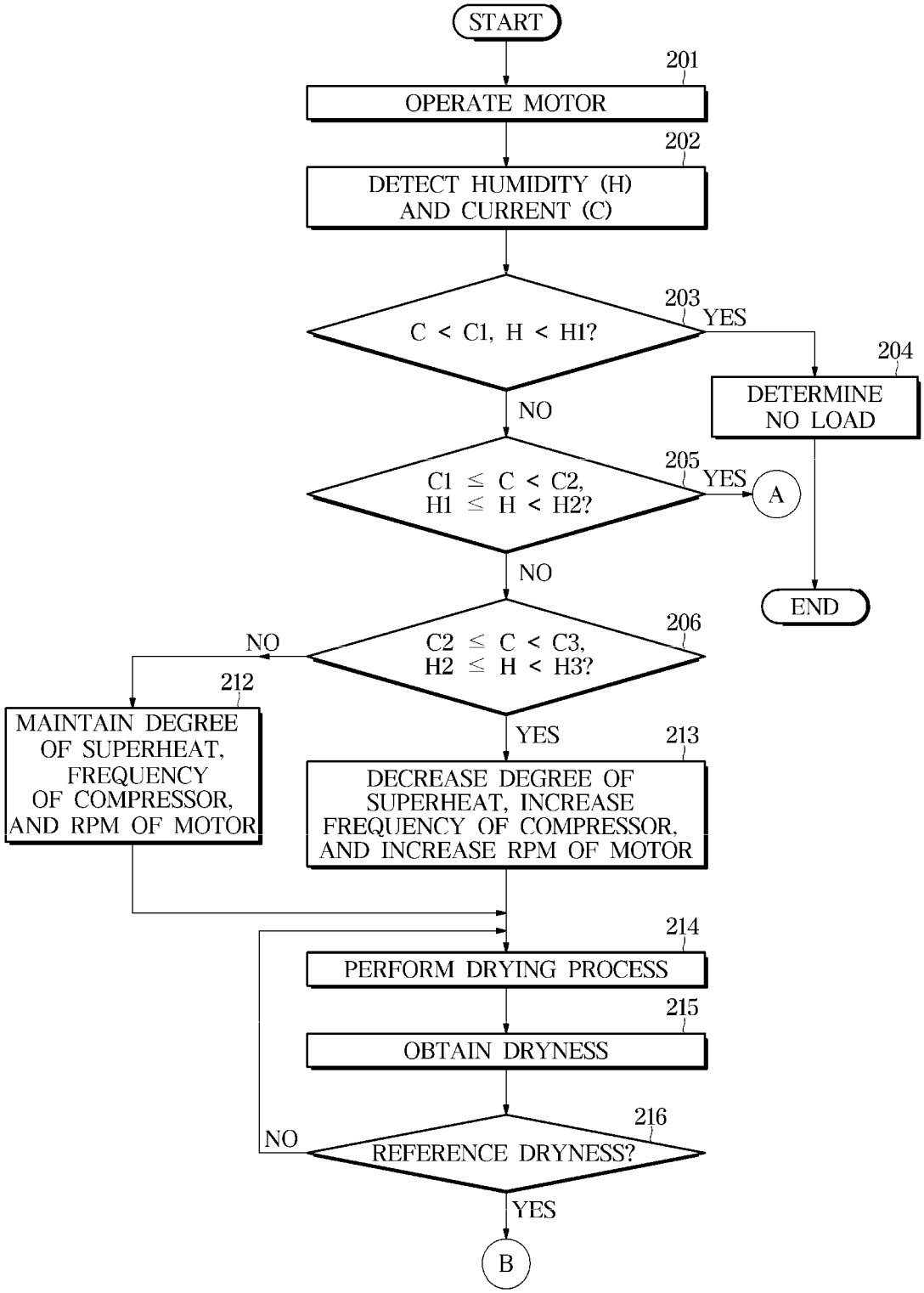
FIGS. 6A, 6B, and 6C are detailed control flowcharts of a dryer according to an embodiment of the disclosure.
Figure 6B:
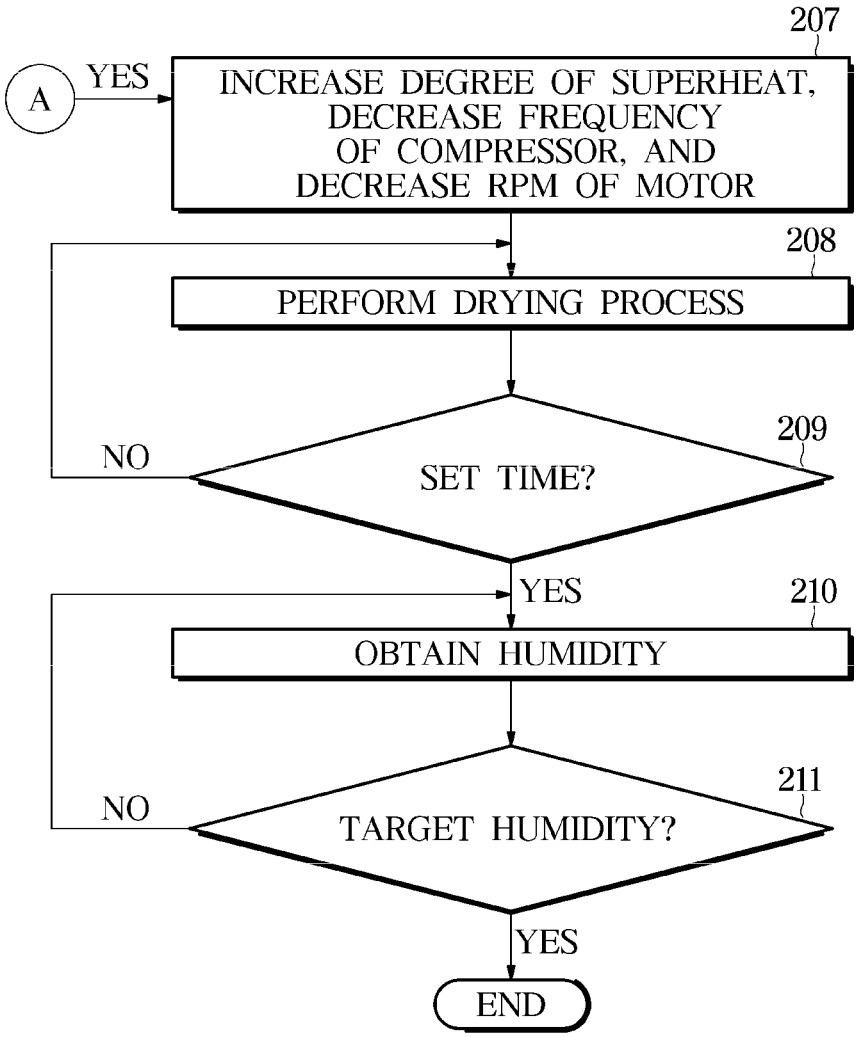
Figure 6C:
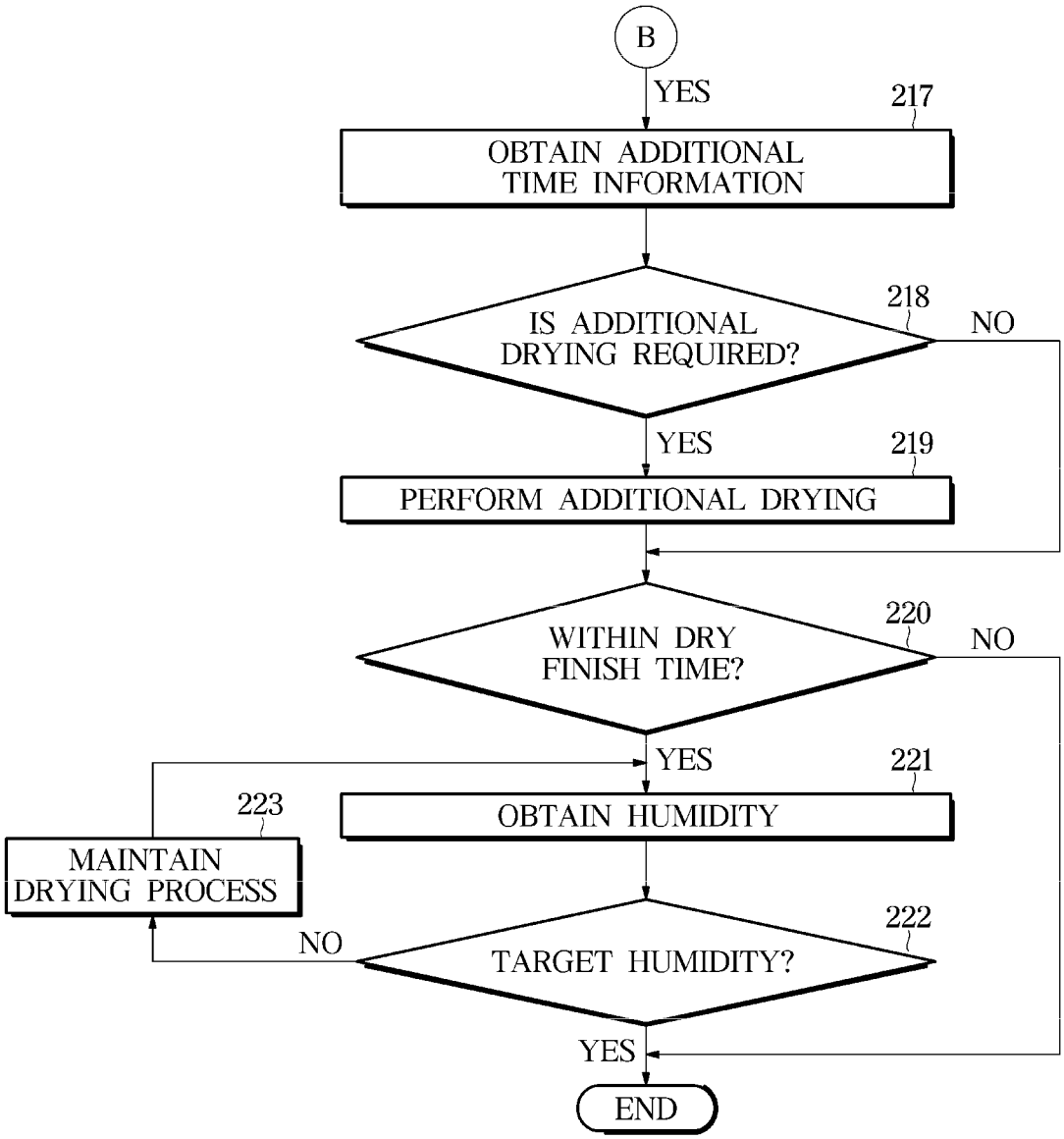

FIGS. 6A, 6B, and 6C are detailed control flowcharts of a dryer according to an embodiment of the disclosure.

In response to reception of a dry start command, the dryer 100 may operate the motor 150 to rotate the drum 120, in operation 201. The dryer 100 may drive the motor 150 for a preset time.

The dryer 100 may detect humidity of a drying material accommodated inside the drum 120 by using the first detector 181, and detect current flowing through the motor 150 by using the second detector 182 while the drum 120 rotates, in operation 202. In this case, the first detector 181 may output humidity information about the detected humidity as detection information, and the second detector 182 may output current information about the detected current as detection information.

At this time, the humidity of the drying material may be estimated from humidity of air entered the exhaust flow passage 141. Also, the humidity of the drying material may be estimated from humidity of air supplied from the air-supply flow passage 142 to the drum 120.

The dryer 100 may compare the humidity information detected by the first detector 181 to reference humidity information stored in the storage device 190*a*, and compare the current information detected by the second detector 182 to reference current information stored in the storage device 190*a* to determine a drying load for the drying material accommodated inside the drum 120 based on a result of the comparison of the humidity information and a result of the comparison of the current information.

Herein, the reference humidity information may include information about first reference humidity, second reference humidity, and third reference humidity, and the reference current information may include information about first reference current, second reference current, and third reference current.

For example, a drying load may be classified into a small load, a medium load that is more than the small load, and a large load that is more than the medium load.

An operation of determining a drying load will be described in more detail, below.

The dryer 100 may compare detected humidity H to first reference humidity H1 and compare detected current C to first reference current C1. That is, in response to the detected humidity H that is lower than the first reference humidity H1 and the detected current C that is lower than the first reference current C1, in operation 203, the dryer 100 may determine no load representing that no drying material is accommodated in the drum 120, in operation 204.

The dryer 100 may enter a dry standby mode or be powered off in response to the determination of no load. In response to the determination of no load, the dryer 100 may display notification information for no load through the display 172 or output notification information for no load as sound through a sound outputter.

In response to the detected humidity H that is higher than or equal to the first reference humidity H1 and the detected current C that is higher than or equal to the first reference current C1, the dryer 100 may determine whether the detected humidity H is higher than or equal to the first reference humidity H1 and lower than second reference humidity H2 and the detected current C is higher than or equal to the first reference current C1 and lower than second reference current C2, in operation 205.

In response to the detected humidity H that is higher than or equal to the first reference humidity H1 and lower than the second reference humidity H2 and the detected current C that is higher than or equal to the first reference current C1 and lower than the second reference current C2, the dryer 100 may determine the drying load to be the small load.

In response to the detected humidity H and the detected current C that do not satisfy conditions corresponding to the small load, the dryer 100 may determine whether the detected humidity H is higher than or equal to the second reference humidity H2 and lower than third reference humidity H3 and the detected current C is higher than or equal to the second reference current C2 and lower than third reference current C3, in operation 206.

In response to the detected humidity H that is higher than and equal to the second reference humidity H2 and lower than the third reference humidity H3 and the detected current C that is higher than or equal to the second reference current C2 and lower than the third reference current C3, the dryer 100 may determine the drying load to be the medium load.

In response to the detected humidity H and the detected current C that do not satisfy conditions corresponding to the medium load, the dryer 100 may determine the drying load to be the large load. That is, in responses to the detected humidity H that is higher than the third reference humidity H3 and the detected current C that is higher than the third reference current C3, the dryer 100 may determine the drying load to be the large load.

The dryer 100 may obtain a drying algorithm corresponding to the determined drying load, and control a drying process based on the drying algorithm.

A drying process control corresponding to a drying load will be described in more detail, below.

In response to a drying load determined to be the small load, the dryer 100 may obtain a drying algorithm corresponding to the small load, and control driving of the motor 150, the compressor 164, and the expansion valve 162 to perform a drying process based on the drying algorithm.

More particularly, in response to a drying load determined to be the small load, the dryer 100 may control the motor 150 to operate at a smaller rpm than a set rpm, control the compressor 164 to operate at a lower frequency than a set frequency, and control an opening degree of the expansion valve 162 to obtain a greater degree of superheat than a set degree of superheat, in operation 207, and then perform a drying process, in operation 208.

That is, the dryer 100 may decrease the rpm of the motor 150 to be smaller than the set rpm, decrease the frequency of the compressor 164 to be lower than the set frequency, and increase the degree of superheat of the evaporator 163 to be greater than the set degree of superheat, based on the drying algorithm corresponding to the small load, and then perform a drying process.

Increasing the degree of superheat of the evaporator 163 may include obtaining information about a degree of superheat of the evaporator 163, based on temperature information of the evaporator 163, detected by the third detector 183, and pressure information of the evaporator 163, detected by the fourth detector 184, obtaining the degree of superheat of the evaporator 163 corresponding to the information about the degree of superheat, and controlling an opening degree of the expansion valve 162 to be smaller than a current opening degree such that the evaporator 163 has a degree of superheat that is greater than the obtained degree of superheat.

Also, an opening degree of the expansion valve 162 corresponding to an increase amount of a degree of superheat may have been set in advance. The dryer 100 may check an increase amount of a degree of superheat, check an opening degree corresponding to the checked increase amount, and decrease an opening degree of the expansion valve 162 by the checked opening degree.

A frequency decrease amount of the compressor 164 and a rpm decrease amount of the motor 150 may also have been set in advance.

As such, in response to a drying load determined to be the small load, the dryer 100 may increase the degree of superheat of the evaporator 163 to thus reduce an amount of a refrigerant circulating in the cooling cycle portion 160*a*, and may decrease the rpm of the motor 150 to thus reduce an amount of air circulating through the fan 140 and reduce the number of tumbling operations of a drying material inside the drum 120.

Also, the dryer 100 may decrease the frequency of the compressor 164 to reduce a load of the compressor 164, thereby lowering temperature of air that is heated through heat exchange in the condenser 161. Accordingly, the dryer 100 may reduce power that is consumed by drying during a dry finish time corresponding to the small load.

In response to a drying load determined to be the small load, the dryer 100 may measure a drying time while performing a drying process, determine whether the drying time reaches a set time in operation 209, obtain humidity of a drying material based on detection information detected by the first detector 181 at a drying time that reaches the set time in operation 210, and compare the humidity to target humidity, in operation 211.

The drying time may be an elapsed time from a start time of the drying process to a current time.

The set time may be a time for obtaining humidity of a drying material, and may be a time that is earlier by a predefined time than a first dry finish time corresponding to the small load.

The humidity of the drying material may be humidity of air flowing through the exhaust flow passage 141, or humidity of air flowing through the air-supply flow passage 142.

In response to humidity determined to exceed the target humidity, the dryer 100 may maintain the drying process, and, in response to humidity determined to reach the target humidity, the dryer 100 may finish the drying process. That is, the dryer 100 may maintain the drying process until detected humidity reaches the target humidity.

The dryer 100 may determine that a drying time reaches the first dry finish time, while performing the drying process. In this case, the dryer 100 may finish the drying process.

At a drying time that reaches a maximum dry finish time, the dryer 100 may finish the drying process. The maximum dry finish time may be longer than the first dry finish time. Also, the maximum dry finish time may be a third dry finish time corresponding to the large load. The effect of the current embodiment will be described with reference to FIG. 7, below.

Figure 7:
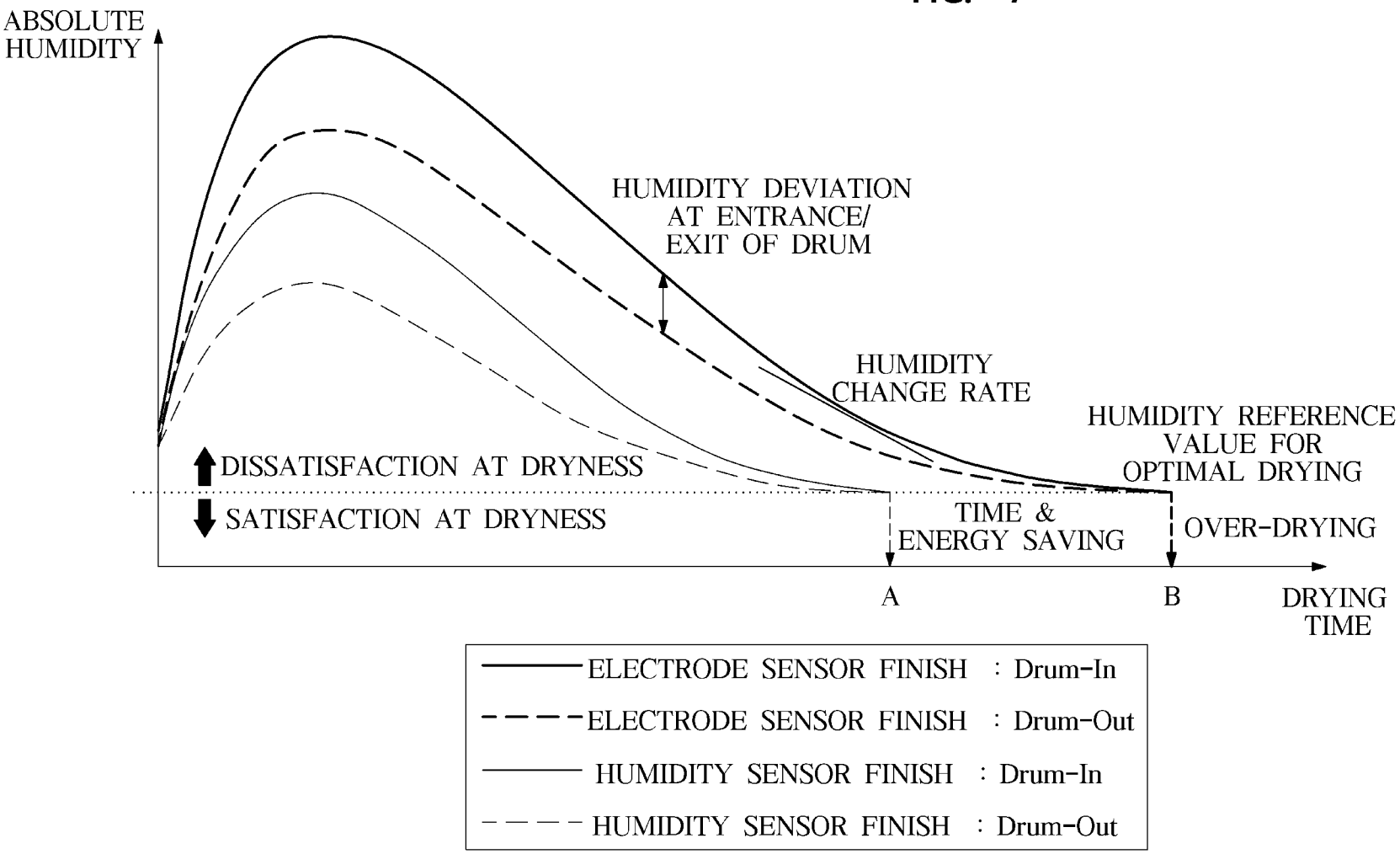
FIG. 7 is a graph showing absolute humidity over drying time upon drying of a small load in a dryer according to an embodiment of the disclosure and a conventional dryer.

FIG. 7 is a graph showing absolute humidity over drying time upon drying of a small load in a dryer according to an embodiment of the disclosure.

FIG. 7 shows a graph of absolute humidity which is humidity of air discharged from the drum 120 during a drying process of a drying material, detected by a humidity sensor of the dryer 100 according to an embodiment of the disclosure, a graph of absolute humidity which is humidity of air supplied to the drum 120 during a drying process of a drying material, detected by a drying sensor of the dryer 100, a graph of absolute humidity which is humidity of air discharged from the drum 120 during a drying process of a drying material, detected by an electrode sensor of an existing dryer, and a graph of absolute humidity which is humidity of air supplied to the drum 120 during drying process of a drying material, detected by an electrode sensor of the dryer 100.

In FIG. 7, a point A is a time at which drying is finished upon drying of a small load through the dryer 100 according to an embodiment of the disclosure, and the point A has been determined by humidity sensed by the humidity sensor.

In FIG. 7, a point B is a time at which drying is finished upon drying of a small load through the existing dryer, and the point B has been determined by a dryness sensed by the electrode sensor.

Referring to FIG. 7, it is seen that existing technology of determining a dryness through a contact to a drying material by using the electrode sensor results in low accuracy of a dryness of a small load. For this reason, over-drying may be caused, which leads to cloth damage and energy excessive consumption.

However, the current embodiment of the disclosure may determine a dryness of a drying material by using the humidity sensor, thereby satisfying drying quality, reducing a drying time, and saving energy.

In response to a drying load determined to be the medium load, the dryer 100 may check a drying algorithm corresponding to the medium load, and control driving of the motor 150, the compressor 164, and the expansion valve 162 such that a drying process is performed based on the drying algorithm.

More particularly, in response to a drying load determined to be the medium load, the dryer 100 may control the motor 150 to operate at a predefined rpm, control the compressor 164 to operate at a predefined frequency, and control an opening degree of the expansion valve 162 such that a degree of superheat of the evaporator 163 reaches a set degree of superheat. Herein, controlling the opening degree of the expansion valve 162 may include controlling the opening degree of the expansion valve 162 to a set opening degree.

That is, the dryer 100 may perform a drying process, while maintaining the rpm of the motor 150 at the set rpm, maintaining the frequency of the compressor 164 at the set frequency, and maintaining the degree of superheat of the evaporator 163 at the set degree of superheat based on the drying algorithm corresponding to the medium load, in operations 212 and 214.

In response to a drying load determined to be the large load, the dryer 100 may check a drying algorithm corresponding to the large load, and control driving of the motor 150, the compressor 164, and the expansion valve 162 to perform a drying process based on the drying algorithm.

In response to the drying load determined to be the large load, the dryer 100 may control the motor 150 to operate at a greater rpm than the set rpm, control the compressor 164 to operate at a higher frequency than the set frequency, and control an opening degree of the expansion valve 162 such that a degree of superheat of the evaporator 163 is smaller than the set degree of superheat, and then the dryer 100 may perform a drying process.

That is, the dryer 100 may increase the rpm of the motor 150 to be greater than the set rpm, increase the frequency of the compressor 164 to be higher than the set frequency, and decrease the degree of superheat of the evaporator 163 to be smaller than the set degree of superheat, based on the drying algorithm corresponding to the large load, in operation 213, and thereafter, the dryer 100 may perform a drying process, in operation 214.

Decreasing the degree of superheat of the evaporator 163 may include obtaining information about a degree of superheat of the evaporator 163, based on temperature information of the evaporator 163, detected by the third detector 183 and pressure information of the evaporator 163, detected by the fourth detector 184, obtaining a degree of superheat of the evaporator 163 corresponding to the information about the degree of superheat, and controlling an opening degree of the expansion valve 162 to be greater than a current opening degree such that the evaporator 163 has a smaller degree of superheat than the obtained degree of superheat.

Also, an opening degree of the expansion valve 162 corresponding to a decrease amount of a degree of superheat may have been set in advance. The dryer 100 may check a decrease amount of a degree of superheat, obtain an opening degree corresponding to the decrease amount of the degree of superheat, and increase an opening degree of the expansion valve 162 by the opening degree.

A frequency increase amount of the compressor 164 and a rpm increase amount of the motor 150 may also have been set in advance.

As such, the dryer 100 may decrease a degree of superheat to increase an amount of a refrigerant circulating in the cooling cycle portion 160*a*, and increase a rpm of the motor 150 to increase an amount of air circulating through the fan 140 while increasing the number of tumbling operations of a drying material inside the drum 120. Also, the dryer 100 may increase a frequency of the compressor 164 to increase a load of the compressor 164 to raise temperature of air being heat-exchanged in the condenser 161, thereby raising temperature of air for drying.

Accordingly, the dryer 100 may reduce a time taken for drying during a dry finish time corresponding to the large load.

In response to a drying load determined to be the medium load or the large load, the dryer 100 may obtain a dryness of a drying material based on detection information detected through an electrode sensor which is the fifth detector 185, while performing a drying process, to determine additional drying, in operation 215.

Obtaining the dryness of the drying material may be counting the number of electrical signals received through the electrode sensor for a predefined time period, obtaining a pulse value corresponding to the count number of electrical signals, and obtaining a dryness of a drying material based on the pulse value. The received electrical signals may be pulse signals, and the predefined time period may be one minute.

In response to the obtained dryness determined to be a reference dryness in operation 216, the dryer 100 may check a drying time, obtain additional time information based on the drying time in operation 217, and perform additional drying based on the additional time information.

The drying time may be an elapsed time from a reception time of a dry start command to a time at which the obtained dryness reaches the reference dryness.

The additional time information may include information about a time resulting from multiplying the drying time by a predefined coefficient. That is, as the drying time is longer, an additional time may be lengthened.

According to the additional time, a second dry finish time corresponding to the medium load or a third dry finish time corresponding to the large load may also be extended. For example, in response to a drying load determined to be the medium load, a dry finish time may be extended by the additional time from the second dry finish time, and, in response to the drying load determined to be the large load, a dry finish time may be extended by the additional time from the third dry finish time.

In response to a determination that additional drying is required based on the additional time information in operation 218, the dryer 100 may perform an additional drying operation based on the additional time information, in operation 219.

Also, in response to the dryness that reaches the reference dryness even though the drying time is shorter than or equal to a reference time, the dryer 100 may perform no additional drying. In this case, a dry finish time of the dryer 100 may be the second dry finish time corresponding to the medium load or the third dry finish time corresponding to the large load.

While the dryer 100 performs a drying process when the time is within the dry finish time, in operation 220, the dryer 100 may obtain humidity of the drying material based on detection information detected by the first detector 181, in operation 221, and determine whether the humidity is target humidity, in operation 222. In response to humidity determined to be the target humidity, the dryer 100 may finish the drying process.

In contrast, in response to humidity determined to exceed the target humidity, the dryer 100 may maintain the drying process, in operation 223.

The dryer 100 may compare the humidity to the target humidity until a drying time reaches the dry finish time, while the drying process is maintained, and finish the drying process in response to humidity that reaches the target humidity.

At a drying time that reaches the dry finish time, the dryer 100 may finish the drying process.

Upon maintenance of the dry finish time, the dryer 100 may check an opening degree of the expansion valve 162 while performing the drying process, and perform a control operation of finishing the drying process in response to an opening degree of the expansion valve 162 determined to be a target opening degree.

Upon extension of the dry finish time, the dryer 100 may obtain humidity of the drying material based on detection information detected by the first detector 181 while performing additional drying, and compare the obtained humidity to the target humidity.

The dryer 100 may determine whether the humidity is the target humidity, and, in response to humidity determined to be the target humidity, the dryer 100 may finish the additional drying.

While the drying process is maintained, the dryer 100 may continue to compare the humidity to the target humidity until a drying time reaches the extended dry finish time, and finish the drying process at a drying time that reaches the extended dry finish time.

The dryer 100 may finish the drying process at a drying time that reaches the extended dry finish time.

Also, in response to humidity determined to exceed the target humidity even though the drying time reaches the extended dry finish time, the dryer 100 may maintain the drying process. In this case, the dryer 100 may maintain the drying process until the drying time reaches a maximum dry finish time, and finish the drying process at the drying time that reaches the maximum dry finish time. Herein, the maximum dry finish time may be longer than the third dry finish time.

Upon extension of the dry finish time, the dryer 100 may check an opening degree of the expansion valve 162 while performing the drying process, and, in response to an opening degree of the expansion valve 162 determined to be the target opening degree, the dryer 100 may perform a control operation of finishing the drying process. The effect of the current embodiment will be described with reference to FIG. 8, below.

Figure 8:
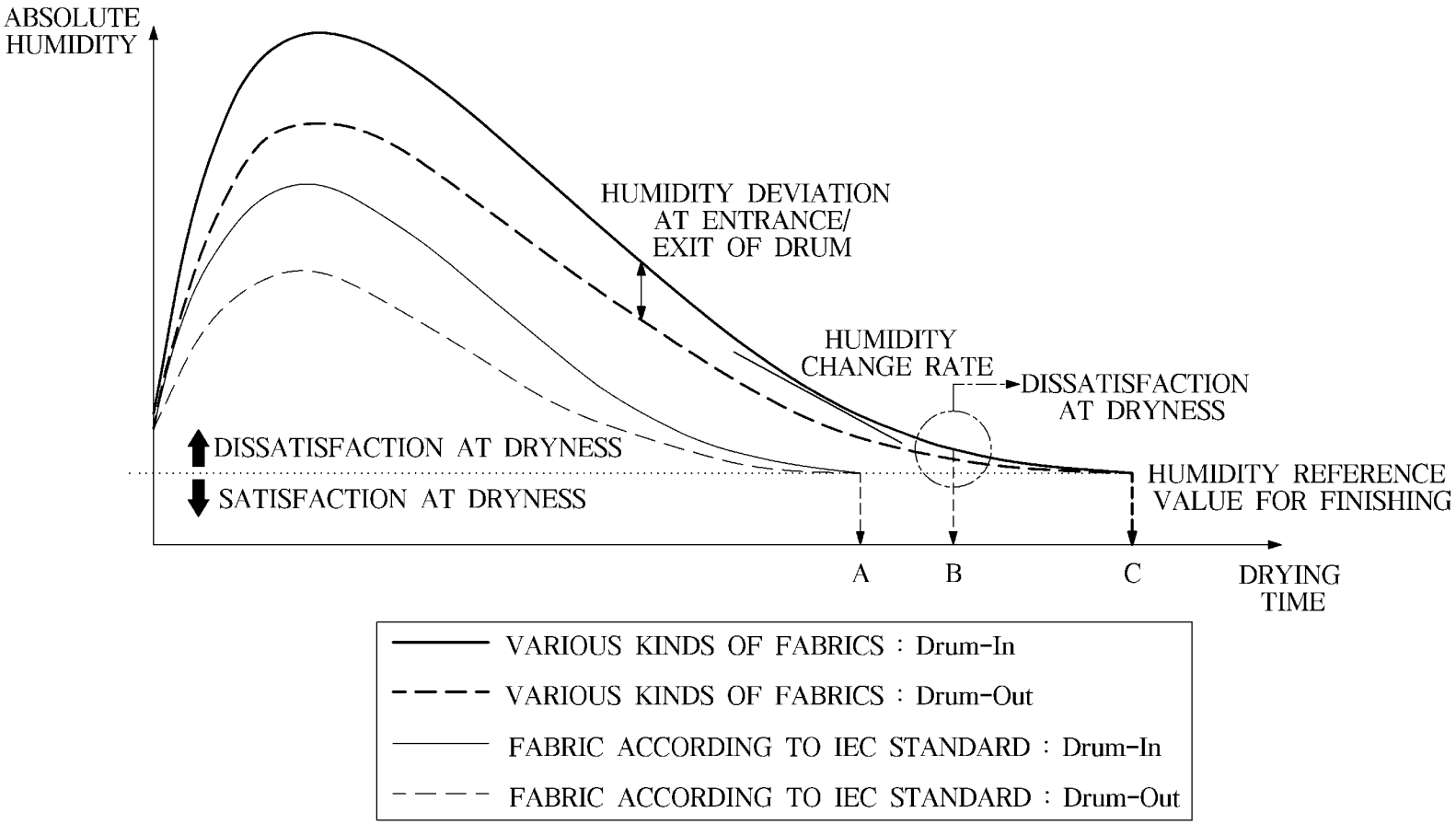
FIG. 8 is a graph showing absolute humidity over drying time according to kinds of fabrics upon drying of a medium/large load in a dryer according to an embodiment of the disclosure and a conventional dryer.

FIG. 8 is a graph showing absolute humidity over drying time according to kinds of fabrics upon drying of a medium/large load in a dryer according to an embodiment of the disclosure and an existing dryer.

FIG. 8 shows a graph of absolute humidity which is humidity of air discharged from the drum 120 and a graph of absolute humidity which is humidity of air supplied to the drum 120, upon drying of drying materials being various kinds of fabrics, and a graph of absolute humidity which is humidity of air discharged from the drum 120 and a graph of absolute humidity which is humidity of air supplied to the drum 120, upon drying of a fabric (100% cotton) according to the International Electrotechnical Commission (IEC) standard.

In FIG. 8, a point A is a time at which drying is finished upon drying of a medium/large fabric (100% cotton) according to the IEC standard through the dryer 100 according to an embodiment of the disclosure, and the point A has been determined by humidity sensed by the humidity sensor.

In FIG. 8, a point B is a time at which drying is finished upon drying of various kinds (various kinds of fabrics) of medium/large drying materials through the existing dryer, and the point B has been determined by a dryness sensed by the electrode sensor.

In FIG. 8, a point C is a time at which drying is finished upon drying of various kinds (that is, various kinds of fabrics) of medium/large drying materials through the dryer 100 according to an embodiment of the disclosure, and the point C has been determined by humidity sensed by the humidity sensor.

Actually, various kinds of drying materials are dried through a dryer. In this regard, it is seen from absolute humidity over drying time upon drying of various kinds of drying materials that a user could satisfy drying quality upon a determination of drying finishing based on humidity sensed by a humidity sensor rather than upon a determination of drying finishing based on a dryness sensed by an electrode sensor.

Also, it is seen from FIG. 8 that, upon a determination of a dryness corresponding to humidity of a drying material through the humidity sensor, preset drying quality is satisfied regardless of kinds, thicknesses, or amounts of fabrics. The current embodiment may reduce a drying time and save energy accordingly.

The current embodiment may determine whether to finish a drying process based on humidity detected by the first detector 181. This will be described with reference to FIG. 9, below.

The dryer 100 may obtain a humidity value of air discharged from the drum 120, and determine whether to finish a drying process, based on a humidity change rate and a humidity change pattern over time, and a set dryness.

$$\text{Humidity Change Rate}(G)=(H2_air-H1_air)/(t2-t1)$$

H2_air: absolute humidity detected by the humidity sensor in the exhaust flow passage (that is, the outlet) 141 of the drum 120 at a time t2

H1_air: absolute humidity detected by the humidity sensor in the exhaust flow passage (that is, the outlet) 141 of the drum 120 at a time t1

$$\text{Humidity Change Pattern}\ (P)=(Pt2-Pt0)/(t2-t0)$$

Pt2: absolute humidity in the exhaust flow passage (that is, the outlet) 141 of the drum 120 at the time t2

Pt0: absolute humidity in the exhaust flow passage (that is, the outlet) 141 of the drum 120 at a time t0

Gend: a reference change rate for determining a finish time corresponding to a dryness For example, t2 may be a current time, t1 may be a time that is earlier by 5 seconds than the current time, and t0 may be a time that is earlier by 60 seconds than the current time.

As shown in FIG. 9, in response to setting of a first dryness (weak), the dryer 100 may finish drying in the case that a humidity value is smaller than or equal to 40 g/m$^3$, a humidity change pattern is smaller than or equal to 0, and a humidity change rate G that is smaller than or equal to a first reference change rate (Gend, about −0.08) is maintained for one minute.

In response to setting of a second dryness (medium), the dryer 100 may finish drying in the case that a humidity value is smaller than or equal to 35 g/m$^3$, a humidity change pattern is smaller than or equal to 0, and a humidity change rate G that is smaller than or equal to a second reference change rate (Gend, about −1.0) is maintained for one minute.

In response to setting of a third dryness (strong), the dryer 100 may finish drying in the case that a humidity value is smaller than or equal to 30 g/m$^3$ and a humidity change rate G that is smaller than or equal to a third reference change rate (Gend, about −1.2) is maintained for one minute.

The dryer 100 may determine whether to finish drying based on a first humidity value of air discharged from the drum 120 and a second humidity value of air to be supplied to the drum 120. That is, the dryer 100 may obtain a humidity difference value ΔG between the first humidity value and the second humidity value, obtain a change rate of the first humidity value over time, and determine whether to finish drying based on the set dryness, the first humidity value, the humidity difference value ΔG, and the change rate of the first humidity value. This will be described with reference to FIG. 9, below.

As shown in FIG. 9, in response to setting of a first dryness (weak), the dryer 100 may finish drying in the case in which a first humidity value is smaller than or equal to 40 g/m$^3$, a change rate of the first humidity value is smaller than or equal to 0, and a humidity difference value ΔG that is smaller than or equal to a first reference difference value (Gend, about 5) is maintained for one minute.

In response to setting of a second dryness (medium), the dryer 100 may finish drying in the case in which a first humidity value is smaller than or equal to 35 g/m$^3$, a change rate of the first humidity value is smaller than or equal to 0, and a humidity difference value ΔG that is smaller than or equal to a second reference difference value (Gend, about 2) is maintained for one minute.

In response to setting of a third dryness (strong), the dryer 100 may finish drying in the case in which a first humidity value is smaller than or equal to 30 g/m$^3$, a change rate of the first humidity value is smaller than or equal to 0, and a humidity difference value ΔG that is smaller than or equal to a third reference difference value (Gend, about 0.5) is maintained for one minute.

The dryer 100 may determine whether to finish drying based on humidity of air discharged from the drum 120, detected by the first humidity sensor, and humidity of air to be supplied to the drum 120, detected by the second humidity sensor.

That is, the dryer 100 may obtain a humidity difference value between the humidity detected by the first humidity sensor and the humidity detected by the second humidity sensor, obtain a humidity change pattern of the first humidity sensor over time, and determine whether to finish drying based on the set dryness, the humidity detected by the first humidity sensor, the humidity difference value, and the humidity change pattern of the first humidity sensor. This will be described with reference to FIG. 10, below.

$$\Delta G(\text{humidity difference value})=(\Delta H\ \text{outlet_air_air}-\Delta H\ \text{inlet_air})$$

ΔH outlet_air: humidity value of the first humidity sensor at a time t2

ΔH inlet_air: humidity value of the second humidity sensor at a time t2

$$P(\text{humidity change pattern})=(Pt2-Pt0)/(t2-t0)$$

Pt2: humidity value of the first humidity sensor at a time t2

Pt0: humidity value of the first humidity sensor at a time t0

For example, t2 may be a current time, t1 may be a time that is earlier by 5 seconds than the current time, and t0 may be a time that is earlier by 60 seconds than the current time.

ΔGend: reference difference value for determining a finish time corresponding to a dryness As shown in FIG. 10, in response to setting of a first dryness (weak), the dryer 100 may finish drying in the case in which a first humidity value is smaller than or equal to 40 g/m$^3$, a humidity change pattern is smaller than or equal to 0, and a humidity difference value ΔG that is smaller than or equal to a first reference difference value (Gend, about 5) is maintained for one minute.

In response to setting of a second dryness (medium), the dryer 100 may finish drying in the case in which a first humidity value is smaller than or equal to 35 g/m$^3$, a change rate is smaller than or equal to 0, and a humidity difference value ΔG that is smaller than or equal to a second reference difference value (Gend, about 2) is maintained for one minute.

In response to setting of a third dryness (strong), the dryer 100 may finish drying in the case in which a first humidity value is smaller than or equal to 30 g/m$^3$, a change rate is smaller than or equal to 0, and a humidity difference value ΔG that is smaller than or equal to a third reference difference value (Gend, about 0.5) is maintained for one minute.

Figure 11:
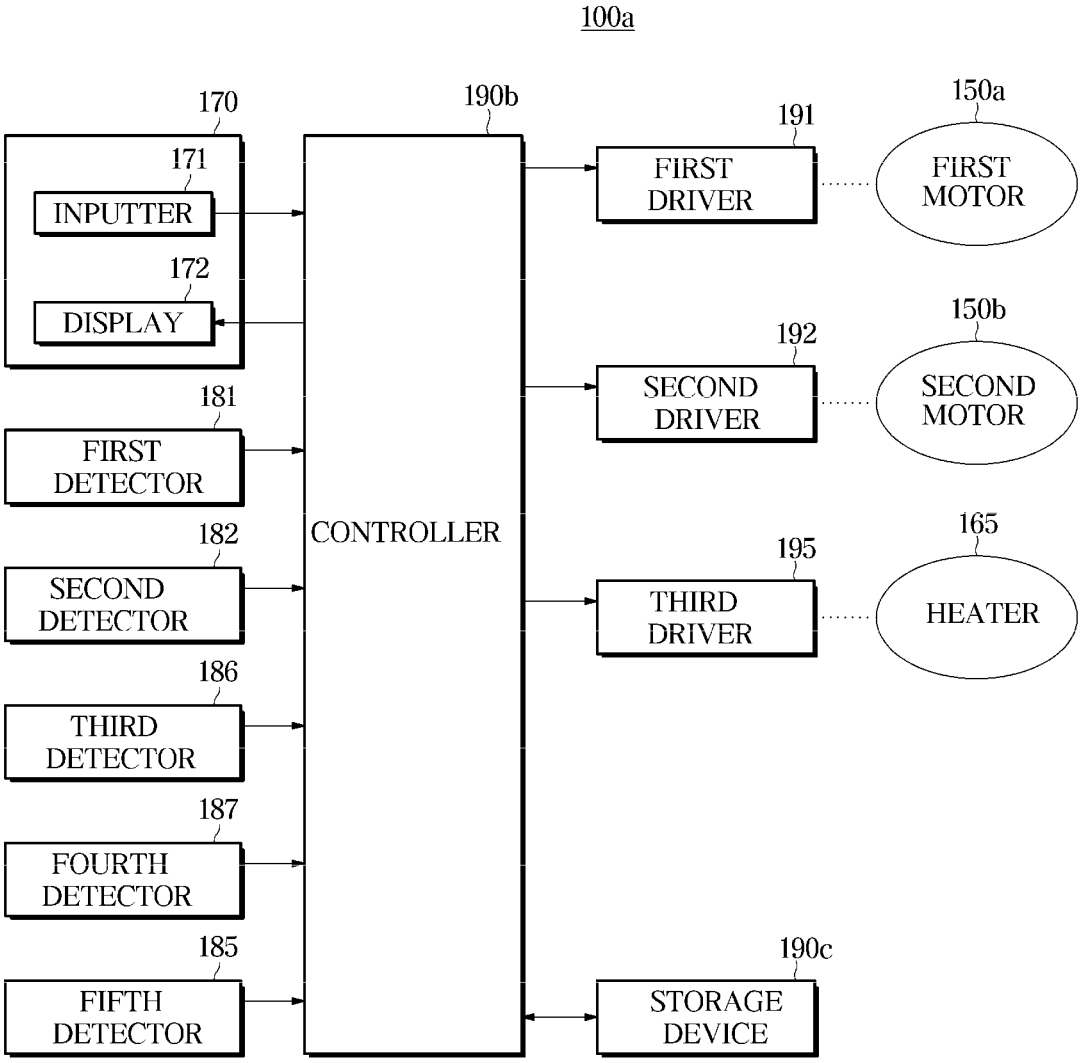
FIG. 11 is a control configuration diagram of a dryer according to another embodiment of the disclosure.

FIG. 11 is a control configuration diagram of a dryer according to another embodiment of the disclosure.

A dryer 100*a* according to another embodiment of the disclosure may include a first motor 150*a*, a second motor 150*b*, the heater 165, the user interface 170, a plurality of detectors (that is, a first detector 181, a second detector 182, a third detector 186, a fourth detector 187, and a fifth detector 185), a controller 190*b*, a storage device 190*c*, and a plurality of drivers 191, 194, and 195.

The dryer 100*a* may include the first motor 150*a* for driving the drum 120, and the second motor 150*b* for driving the fan 140. That is, the second motor 150*b* for the fan 140 and the first motor 150*a* for the drum 120 may be provided separately inside the dryer 100*a*.

The dryer 100*a* may include a heat source for drying a drying material accommodated in the drum 120. The heat source may include the heater 165. Two or more heaters may be provided inside the dryer 100*a*.

The user interface 170 may be the same as that used in the above-described embodiment, and accordingly, a detailed description about the user interface 170 will be omitted.

The first detector 181 may include a humidity sensor positioned on an exhaust flow passage to detect humidity of air discharged from the drum 120. The first detector 181 positioned on the exhaust flow passage may be a temperature-humidity sensor for detecting both humidity and temperature.

The second detector 182 may detect an electrical signal applied to the first motor 150*a* to recognize operation information of the first motor 150*a*, and output the electrical signal.

The second detector 182 may include a current sensor connected to the first motor 150*a* to detect current applied to the first motor 150*a*.

The third detector 186 may include a humidity sensor positioned on an air-supply flow passage to detect humidity of air to be supplied to the drum 120. The third detector 186 positioned on the air-supply flow passage may be a temperature-humidity sensor for detecting both humidity and temperature.

The fourth detector 187 may be positioned around the heater 165, and detect temperature of air around the heater 165.

The fifth detector 185 may include an electrode sensor positioned in the drum 120 to detect a dryness of a drying material accommodated inside the drum 120.

During a drying process, the controller 190*b* may control on/off operations of the heater 165, or control an output capacity of at least one of a voltage or current that is applied to the heater 165 through pulse width modulation (PWM), thereby adjusting temperature of air.

The heat source may include two heaters. In this case, the controller 190*b* may control on/off operations of at least one heater, or control an output capacity of at least one of a voltage or current that is applied to at least one heater through PWM, thereby adjusting temperature of air.

The controller 190*b* may obtain humidity information of a drying material based on detection information detected by the first detector 181. The humidity information of the drying material may be predicted from humidity of air entered the exhaust flow passage.

The controller 190*b* may obtain information about current flowing through the motor 150 based on detection information detected by the second detector 182, and determine a drying load of the drying material accommodated in the drum 120 based on the information about the current and the humidity information. For example, the drying load may be classified into a small load, a medium load that is more than the small load, and a large load that is more than the medium load.

The controller 150*b* may compare the humidity information to a plurality of pieces of pre-stored reference humidity information, compare the information about the current to a plurality of pieces of pre-stored reference current information, and determine a drying load based on a result of the comparison of the humidity information and a result of the comparison of the current information. This operation has been described above in the above-described embodiment, and therefore, a detailed description thereof will be omitted.

The controller 190*b* may control a rpm of the second motor 150*b* to correspond to the determined drying load to thereby adjust a rpm of the fan 140. The controller 190*b* may control a rpm of the first motor 150*a* to correspond to the determined drying load to thereby adjust a rpm of the drum 120.

In response to the drying load determined to be the medium load, the controller 190*b* may obtain a drying algorithm corresponding to the medium load, and control the first motor 150*a*, the second motor 150*b*, and the heater 165 to perform a drying process based on the drying algorithm.

That is, in response to the drying load determined to be the medium load, the controller 190*b* may control driving of the first motor 150*a* such that a rpm of the first motor 150*a* is maintained at a first rpm, control driving of the second motor 150*b* such that a rpm of the second motor 150*b* is maintained at a second rpm, and control driving of the heater 165 such that an output capacity of the heater 165 is maintained at a set capacity.

In response to the drying load determined to be the small load, the controller 190*b* may obtain a drying algorithm corresponding to the small load, and control the first motor 150*a*, the second motor 150*b*, and the heater 165 to perform a drying process based on the drying algorithm.

That is, in response to the drying load to be the small load, the controller 190*b* may control a rotation of the first motor 150*a* such that a rpm of the first motor 150*a* is maintained at a rpm that is smaller than the first rpm, control a rotation of the second motor 150*b* such that a rpm of the second motor 150*b* is maintained at a rpm that is smaller than the second rpm, and control driving of the heater 165 with an output capacity that is smaller than the set capacity. In this case, decrease amounts in rpm of the first motor 150*a* and the second motor 150*b* and a decrease amount in output capacity of the heater 165 may have been set in advance.

In response to the drying load determined to be the large load, the controller 190*b* may obtain a drying algorithm corresponding to the large load, and control the first motor 150*a*, the second motor 150*b*, and the heater 165 to perform a drying process based on the drying algorithm.

That is, in response to the drying load determined to be the large load, the controller 190*b* may control a rotation of the first motor 150*a* such that a rpm of the first motor 150*a* is maintained at a rpm that is greater than the first rpm, control a rotation of the second motor 150*b* such that a rpm of the second motor 150*b* is maintained at a rpm that is greater than the second rpm, and control driving of the heater 165 with an output capacity that is greater than the set capacity. In this case, increase amounts in rpm of the first motor 150*a* and the second motor 150*b* and a decrease amount in output capacity of the heater 165 may have been set in advance.

In response to the drying load determined to be the medium load or the large load, the controller 190*b* may control additional drying based on dryness information detected by the fifth detector 185. This configuration has also been described above in the above-described embodiment, and therefore, a detailed description thereof will be omitted.

The controller 190*b* may determine whether to finish drying based on humidity information detected by the first detector 181. This configuration has also been described above in the above-described embodiment, and therefore, a detailed description thereof will be omitted.

The controller 190*b* may determine whether to finish drying based on humidity information detected by the first detector 181 and humidity information detected by the third detector 186 (see FIG. 10).

The storage device 190*c* may store information about a minimum drying finish time and a maximum drying finish time for drying a drying material. Also, the storage device 190*c* may store information about a drying finish time for drying the small load, a drying finish time for drying the medium load, and a drying finish time for drying the large load.

The storage device 190*c* may store information about the first rpm of the first motor 150*a*, the second rpm of the second motor 150*b*, and the set capacity of the heater 165, and also store information about the first, second, and third reference current and the first, second, and third reference humidity for determining a drying load.

The storage device 190*c* may store information about a decrease amount of the first rpm, a decrease amount of the second rpm, and a decrease amount of an output capacity of the heater 165, corresponding to the small load, and information about an increase amount of the first rpm, an increase amount of the second rpm, and an increase amount of an output capacity of the heater 165, corresponding to the large load.

The first driver 191 may drive the first motor 150*a* connected to the drum 120 in response to a control command of the controller 190*b*.

The second driver 194 may drive the second motor 150*b* connected to the fan 140 in response to a control command of the controller 190*b*.

The third driver 195 may change on/off operations of the heater 165 and an output capacity of the heater 165 in response to a control command of the controller 190*b*.

According to the disclosure, by determining a drying load of a drying material accommodated in the drum based on humidity of the drying material and current applied to the drum, accurate information about the drying material may be obtained, and by drying the drying material based on a drying algorithm corresponding to the accurate information about the drying material, a user's satisfaction may be improved.

By controlling the heat pump according to a determined drying load, a load of the cooling cycle may be adjusted, and accordingly, the temperature and volume of hot air to be supplied to the drum may be adjusted. Therefore, a drying time and power consumption may be reduced.

Because whether to finish drying is determined based on humidity detected by the humidity sensor, a drying finish time corresponding to a set dryness may be accurately determined. Accordingly, the drying quality of a drying material may be improved.

Because an amount of moisture removal by the evaporator is predicted based on an opening degree of the expansion valve and whether to finish drying is determined based on the amount of moisture removal, a dry finish time may be more accurately determined.

By detecting a dryness during a drying process by using the electrode sensor and performing additional drying based on the dryness, a user' inconvenience of having to again perform a drying process may be removed.

Because humidity of air contacting a drying material is detected by using the humidity sensor provided in the exhaust flow passage of the drum, a dryness of the drying material may be accurately determined.

As such, because a dryness is determined through the humidity sensor during a drying process, half-drying or over-drying of clothes may be prevented compared to an existing method of determining a dryness through a contact to clothes, thereby improving the drying quality of clothes, preventing damage of clothes that may be caused by over-drying, and finishing drying at an optimal drying time. Accordingly, energy may be saved.

Also, the disclosure may improve the quality and commercial value of the dryer, raise a user's satisfaction, improve the stability of an air conditioner, and secure the competitiveness of a product.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the computer-readable recording medium may be ROM, RAM, a magnetic tape, a magnetic disc, a flash memory, an optical data storage device, etc.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A dryer comprising:

a drum to accommodate a material to be dried;

a motor configured to apply a rotating force to the drum;

a first detector configured to detect humidity of the material and output humidity information corresponding to the detected humidity;

a second detector configured to detect current of the motor and output current information corresponding to the detected current;

a heat source configured to supply hot air to the drum; and a controller configured to determine a drying load based on a comparison of the humidity information received from the first detector to reference humidity information and the current information received from the second detector to reference current information, and control a revolutions per minute (rpm) of the motor or the heat source based on the drying load determined.

2. The dryer of claim 1, wherein the heat source comprises a compressor, a condenser connected to the compressor, an expansion valve connected to the condenser, an evaporator connected to the expansion valve, and a heat pump configured to circulate a refrigerant, in an order, to the compressor, the condenser, the expansion valve, and the evaporator, wherein the heat pump is further configured to supply air heat-exchanged in the condenser to the drum, and control moisture included in air discharged from the drum through heat exchange in the evaporator.

3. The dryer of claim 2, wherein the controller is further configured to control a frequency of the compressor based on the drying load determined.

4. The dryer of claim 2, wherein the controller is further configured to control an opening degree of the expansion valve to adjust a degree of superheat of the evaporator based on the drying load determined.

5. The dryer of claim 2, wherein the controller is further configured to check an opening degree of the expansion valve while a drying process is performed based on the drying load determined, and perform a control operation of finishing the drying process in response to the opening degree checked being at a target opening degree.

6. The dryer of claim 1, wherein the controller is further configured to:

control, in response to the drying load determined to be a small load, the motor to operate at a rpm that is smaller than a set rpm, and control, in response to the drying load determined to be a large load, the motor to operate at a rpm that is greater than the set rpm.

7. The dryer of claim 1, wherein the controller is further configured to perform a control operation of finishing a drying process based on the humidity detected by the first detector while the drying process is performed.

8. The dryer of claim 1, further comprising:

an electrode sensor provided in the drum and configured to output an electrical signal in response to a contact to the material, wherein the controller is further configured to obtain, in response to the drying load determined to be a medium load or a large load, a dryness of the material based on the electrical signal of the electrode sensor, and obtain additional time information for additional drying based on time information corresponding to the dryness of the material obtained as a reference dryness.

9. The dryer of claim 8, wherein the controller is further configured to perform a control operation of finishing a drying process based on the humidity detected by the first detector while an additional drying process is performed based on the additional time information.

10. The dryer of claim 8, wherein the controller is further configured to check an opening degree of an expansion valve while an additional drying process is performed based on the additional time information, and perform a control operation of finishing the drying process in response to the opening degree determined to be a target opening degree.

11. The dryer of claim 1, further comprising a fan connected to the motor and configured to circulate air to inside and outside of the drum, wherein the fan is configured to adjust a volume of air circulating to the inside and the outside of the drum to correspond to a rpm of the motor.

12. The dryer of claim 1, wherein the controller is further configured to determine a drying load to be a small load in response to the detected humidity that is higher than or equal to a first reference humidity and lower than a second reference humidity and the detected current that is higher than or equal to a first reference current and lower than a second reference current.

13. The dryer of claim 1, wherein the controller is further configured to determine no load in the drum and perform a control operation of finishing a drying process in response to the detected humidity that is lower than a first reference humidity and the detected current that is lower than a first reference current.

14. The dryer of claim 1, wherein the controller is further configured to:

determine the drying load to be a medium load in response to the detected humidity that is higher than or equal to a second reference humidity and lower than a third reference humidity and the detected current that is higher than or equal to a second reference current and lower than a third reference current, and determine the drying load to be a large load in response to the detected humidity that is higher than or equal to the third reference humidity and the detected current that is higher than or equal to the third reference current.

15. The dryer of claim 1, wherein the first detector comprises a humidity sensor positioned on an exhaust flow passage through which air discharged from the drum moves.

16. The dryer of claim 1, further comprising a fan configured to circulate air to inside and outside of the drum and a fan motor configured to apply a rotating force to the fan, wherein the controller is further configured to control a rpm of the fan motor based on the drying load determined.

17. A method for controlling a dryer including a heat pump, the method comprising:

detecting current flowing through a motor for rotating a drum;

detecting humidity of a material accommodated in the drum;

determining a drying load based on a comparison of the detected humidity to a plurality of information of reference humidity and the detected current to a plurality of information of reference current;

controlling a rpm of the motor or an operation of the heat pump based on the drying load determined;

performing a drying process;

detecting humidity of the material accommodated in the drum while the drying process is performed; and finishing the drying process in response to the detected humidity being determined to be a target humidity.

18. The method of claim 17, wherein the controlling of the operation of the heat pump comprises:

further decreasing a revolutions per minute (rpm) of the motor, further decreasing a frequency of a compressor provided in the heat pump, and further increasing a degree of superheat of an evaporator provided in the heat pump, as an amount of the drying load determined is smaller than a preset amount; and further increasing the rpm of the motor, further increasing the frequency of the compressor, and further decreasing the degree of superheat of the evaporator, as an amount of the drying load determined is greater than the preset amount.

19. The method of claim 17, wherein the performing of the drying process comprises:

obtaining a dryness of the material based on an electrical signal of an electrode sensor provided in the drum;

obtaining additional time information for additional drying based on time information corresponding to the dryness of the material obtained as a reference dryness; and performing additional drying based on the additional time information.

20. The method of claim 17, wherein the performing of the drying process comprises obtaining a degree of superheat of an evaporator provided in the heat pump, and reducing an opening degree of an expansion valve provided in the heat pump based on the degree of superheat, and the finishing of the drying process comprises checking the opening degree of the expansion valve, and performing a control operation of finishing the drying process in response to the opening degree determined being at a target opening degree.

* * * * *